US007728806B2

(12) United States Patent
Shin

(10) Patent No.: US 7,728,806 B2
(45) Date of Patent: Jun. 1, 2010

(54) DEMULTIPLEXING DEVICE AND DISPLAY DEVICE USING THE SAME

(75) Inventor: Dong-Yong Shin, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 954 days.

(21) Appl. No.: 10/997,486

(22) Filed: Nov. 23, 2004

(65) Prior Publication Data

US 2005/0110727 A1 May 26, 2005

(30) Foreign Application Priority Data

Nov. 26, 2003 (KR) ..... 10-2003-0084479

(51) Int. Cl.
*G09G 3/36* (2006.01)

(52) U.S. Cl. ..... 345/98; 345/100

(58) Field of Classification Search ..... 345/87–100, 345/204, 211

See application file for complete search history.

(56) References Cited

U.S. PATENT DOCUMENTS

| | | | |
|---|---|---|---|
| 4,447,812 | A | 5/1984 | Soneda et al. |
| 5,426,447 | A | 6/1995 | Lee |
| 5,510,807 | A | 4/1996 | Lee et al. |
| 5,555,001 | A | 9/1996 | Lee et al. |
| 5,633,653 | A | 5/1997 | Atherton |
| 5,708,454 | A | 1/1998 | Katoh et al. |
| 5,892,493 | A | 4/1999 | Enami et al. |
| 6,097,362 | A | 8/2000 | Kim |
| 6,333,729 | B1 | 12/2001 | Ha |
| 6,348,906 | B1 | 2/2002 | Dawson et al. |
| 6,359,608 | B1 | 3/2002 | Lebrun et al. |
| 6,559,836 | B1 | 5/2003 | Mori |
| 6,667,580 | B2 | 12/2003 | Kim et al. |
| 6,731,266 | B1 | 5/2004 | Jung |
| 6,771,028 | B1 | 8/2004 | Winters |
| 7,015,882 | B2 | 3/2006 | Yumoto |
| 7,038,652 | B2 | 5/2006 | Kang et al. |

(Continued)

FOREIGN PATENT DOCUMENTS

CN 1116454 A 2/1996

(Continued)

OTHER PUBLICATIONS

Chinese Office action for corresponding China Patent Application 2005100738191, indicating relevance of CN 1447302 and JP 2004-29755 listed in this IDS.

(Continued)

*Primary Examiner*—Nitin Patel
(74) *Attorney, Agent, or Firm*—Christie, Parker & Hale, LLP

(57) ABSTRACT

In a display device, a demultiplexer is used to transmit a data current to a data line. The demultiplexer includes a plurality of sample/hold circuits for sampling the time-divided and sequentially input current and holding them to the data line. A plurality of data lines coupled to the demultiplexer are coupled to pixels of the same color, and hence, currents with different levels are transmitted to pixels of different colors. A sample/hold circuit for transmitting a higher level current uses a driving transistor having a larger ratio of a channel width and a channel length.

44 Claims, 15 Drawing Sheets

U.S. PATENT DOCUMENTS

| | | | | |
|---|---|---|---|---|
| 7,193,619 | B2 | 3/2007 | Kimura | |
| 7,256,756 | B2 | 8/2007 | Abe | |
| 7,310,092 | B2 | 12/2007 | Imamura | |
| 7,324,079 | B2 | 1/2008 | Tobita | |
| 7,342,559 | B2 | 3/2008 | Shin | |
| 7,403,176 | B2 | 7/2008 | Chung et al. | |
| 7,468,718 | B2 | 12/2008 | Shin | |
| 7,505,017 | B1 * | 3/2009 | Yeo et al. | 345/88 |
| 2003/0030602 | A1 | 2/2003 | Kasai | |
| 2003/0107561 | A1 * | 6/2003 | Uchino et al. | 345/204 |
| 2003/0132907 | A1 | 7/2003 | Lee et al. | |
| 2003/0179164 | A1 | 9/2003 | Shin et al. | |
| 2004/0032382 | A1 | 2/2004 | Cok et al. | |
| 2004/0056852 | A1 | 3/2004 | Shih et al. | |
| 2004/0227749 | A1 | 11/2004 | Kimura | |
| 2005/0264495 | A1 * | 12/2005 | Shin | 345/76 |
| 2005/0270257 | A1 * | 12/2005 | Shin | 345/76 |

FOREIGN PATENT DOCUMENTS

| | | | |
|---|---|---|---|
| CN | 1301377 | A | 6/2001 |
| CN | 1417771 | A | 5/2003 |
| CN | 1432989 | A | 7/2003 |
| CN | 1447302 | A | 10/2003 |
| CN | 1488131 | | 4/2004 |
| GB | 2 384 102 | A | 7/2003 |
| JP | 02-306293 | | 12/1990 |
| JP | 06-118913 | | 4/1994 |
| JP | 2000-122607 | | 4/2000 |
| JP | 2000-356978 | | 12/2000 |
| JP | 2002-40961 | | 2/2002 |
| JP | 2002-351357 | | 12/2002 |
| JP | 2003-058108 | | 2/2003 |
| JP | 2003-76327 | | 3/2003 |
| JP | 2003-114645 | | 4/2003 |
| JP | 2003-157048 | | 5/2003 |
| JP | 2003-177722 | | 6/2003 |
| JP | 2003-195812 | | 7/2003 |
| JP | 2003-195815 | | 7/2003 |
| JP | 2003-330386 | | 11/2003 |
| JP | 2004-029528 | | 1/2004 |
| JP | 2004-29755 | | 1/2004 |
| JP | 2004-145224 | | 5/2004 |
| KR | 2003-0075946 | | 9/2003 |
| WO | WO 02/39420 | A1 | 5/2002 |
| WO | WO 03/038796 | A1 | 5/2003 |
| WO | WO 03/038797 | | 5/2003 |
| WO | WO 03/091980 | A1 | 11/2003 |

OTHER PUBLICATIONS

Patent Abstracts of Japan, Publication No. 2000-122607, dated Apr. 28, 2000, in the name of Norio Ozawa.
Patent Abstracts of Japan, Publication No. 2000-356978; Publication Date: Dec. 26, 2000; in the name of Yeo et al.
Patent abstract of Japan for publication No. 2002-040961, dated Feb. 8, 2002 in the name of Yoshiharu Hashimoto.
Patent abstract of Japan for publication No. 2003-076327; dated Mar. 14, 2003 in the name of Koichi Iguchi.
Patent Abstracts of Japan, Publication No. 2003-114645, dated Apr. 18, 2003, in the name of Toshiyuki Kasai.
Patent Abstracts of Japan, Publication No. 2003-195812, dated Jul. 9, 2003, in the name of Katsumi Abe.
Patent Abstracts of Japan, Publication No. 2003-195815, dated Jul. 9, 2003, in the name of Akira Yumoto.
Patent abstract of Japan for publication No. 2003-330386; dated Nov. 19, 2003 in the name of Hajime Akimoto, et al.
Patent Abstract of Japan, Publication No. 2004-029755, dated Jan. 29, 2004, in the name of Hiroshi Takahara.
Korean Patent Abstracts, Publication No. 1020030075946, dated Sep. 26, 2003, in the name of O Gyeong Kwon et al.
English Abstract of Chinese Patent Gazette for related China Patent 100409282C, listing China references noted in this IDS.
U.S. Office action dated Sep. 30, 2008, for related U.S. Appl. No. 11/124,926, indicating relevance of listed U.S. and Japan references in this IDS.
China Office action dated Jun. 8, 2007, for CN 200510070218.5, and English translation.
U.S. Office action dated Jan. 9, 2008, for related U.S. Appl. No. 10/990,659, indicating relevance of U.S. references listed in this IDS.
U.S. Office action dated Jan. 11, 2008, for related U.S. Appl. No. 10/992,327, indicating relevance of U.S. references listed in this IDS.
U.S. Office action dated Aug. 12, 2008, for related U.S. Appl. No. 11/112,835, indicating relevance of U.S. references listed in this IDS.
U.S. Office action dated Aug. 13, 2008, for related U.S. Appl. No. 10/992,327, indicating relevance of U.S. references listed in this IDS.
Patent Abstracts of Japan, Publication No. 02-306293, dated Dec. 19, 1990, in the name of Toshikazu Shimizu.
Patent Abstracts of Japan, Publication No. 06-118913, dated Apr. 28, 1994, in the name of Hideki Sashita.
Patent Abstracts of Japan, Publication No. 2003-058108, dated Feb. 28, 2003, in the name of Akira Yumoto et al.
Patent Abstracts of Japan, Publication No. 2003-177722, dated Jun. 27, 2003, in the name of Toshio Miyazawa.
Patent Abstracts of Japan, Publication No. 2004-029528, dated Jan. 29, 2004, in the name of Reiji Hatsutori.
Patent Abstracts of Japan, Publication No. 2004-145224, dated May 20, 2004, in the name of Hayato Nakanishi.
T. Kretz et al; "A 3.4-inch Reflective Colour Active Matrix Liquid Crystal Display without Polarisers";SID 02 Digest, May 2002, pp. 798-801.
M. Ohta et al; "A Novel Current Programmed Pixel for Active Matrix OLED Displays"; SID 03 Digest, May 20, 2003, pp. 108-111.
European Search Report, dated Sep. 22, 2005, for Application No. 05103845.3-2205, in the name of Samsung SDI Co., Ltd.
European Search Report dated Apr. 2, 2008, for European application 05103845.3, indicating relevance of U.S. Patent 6,559,836 listed in this IDS.
SIPO Patent Gazette, dated Oct. 8, 2008, for Chinese application 200510073819.1, noting references listed in this IDS.
U.S. Office action dated Jan. 6, 2009, for related U.S. Appl. No. 10/990,659, indicating relevance of listed reference in this IDS.
U.S. Office action dated Feb. 18, 2009, for related U.S. Appl. No. 11/124,926, listing cited references.
Japanese Office action dated Oct. 6, 2009, for corresponding Japanese application 2004-336903, noting listed International publication in this IDS.
U.S. Office action dated Jun. 2, 2009, for related U.S. Appl. No. 11/124,926, noting U.S. Publication 2005/0110727 corresponding to this application.
U.S. Notice of Allowance dated Jul. 9, 2009, for related U.S. Appl. No. 10/992,327, noting U.S. Patents listed in this IDS.
U.S. Office action dated Jul. 13, 2009, for related U.S. Appl. No. 10/990,659, noting U.S. Publication 2003/0030602 listed in this IDS.

* cited by examiner

DEMULTIPLEXING DEVICE AND DISPLAY DEVICE USING THE SAME

CROSS REFERENCE TO RELATED APPLICATION

This application claims priority to and the benefit of Korea Patent Application No. 10-2003-0084479 filed on Nov. 26, 2003 in the Korean Intellectual Property Office, the entire content of which is incorporated herein by reference.

BACKGROUND OF THE INVENTION (a) Field of the Invention

The present invention relates to a demultiplexing device and a display device using the same. More specifically, the present invention relates to a demultiplexing device for demultiplexing current using a sample/hold circuit.

(b) Description of the Related Art

A display device requires a gate drive integrated circuit (IC) for driving scan lines and a data drive IC for driving data lines. The data drive IC has output terminals corresponding to the number of data lines since it converts digital signals into analog signals and applies the analog signals to all the data lines. A plurality of data drive ICs are used to drive all the data lines since the number of output terminals on a single IC is limited. Hence, demultiplexers are adopted so as to reduce the number of data drive ICs.

For example, a 1:2 demultiplexer receives data signals time-divided and applied by the data drive IC through a signal line, divides them into two data groups, and outputs them to two data lines. Therefore, usage of a 1:2 demultiplexer reduces the number of data drive ICs by half. Recent liquid crystal displays (LCDs) and organic electroluminescent displays are beginning to mount the data drive ICs on the panel, and in this instance, there is a greater need to reduce the number of data drive ICs.

Analog switches are used to configure a demultiplexer. For example, in the case of a 1:2 demultiplexer, two analog switches are coupled between a signal line of the data drive IC and two data lines, and the analog switches are alternately turned on to alternately transmit the data signals time-divided and applied through the signal line to the two data lines. The organic electroluminescent display uses the method of programming data using current in order to program the data on the pixels. When using the analog switches, the time for applying the data current to a data line is half the horizontal period. Therefore, the data current is insufficiently programmed to the pixels since the time for programming the data on the pixels is reduced as compared to using no demultiplexer.

SUMMARY OF THE INVENTION

The present invention provides a demultiplexing device and a display device for reducing the number of data drive ICs without reducing the data programming time.

In accordance with exemplary embodiments of the present invention, a demultiplexer samples and holds the data current corresponding to a pixel of the same color.

In one aspect of the present invention, a display device includes a display region having a plurality of pixels, some having the same color and some having different colors. The pixels display an image responsive to data signals provided through a plurality of data lines. A data driver provides multiplexed data signals corresponding to the data signals through a plurality of signal lines. A demultiplexer unit demultiplexes the multiplexed data signals to generate the data signals. At least two of the pixels of the same color display color as a function of a same one of the multiplexed data signals.

In another aspect of the present invention, a display device includes: a display region which includes a plurality of data lines for transmitting data currents for displaying images, a plurality of scan lines for transmitting select signals, and a plurality of pixels for displaying the images corresponding to the data currents provided by the data lines in response to the select signals provided by the scan lines; a data driver for transmitting multiplexed data currents corresponding to the data currents through a plurality of signal lines; and a demultiplex unit including a plurality of demultiplexers coupled to the signal lines, each of the demultiplexers for receiving one of the multiplexed data currents, and transmitting the data currents to at least two of the data lines. At least one of the demultiplexers includes a plurality of sample/hold circuits. At least two of the sample/hold circuits sample the one of the multiplexed data currents applied through an input terminal, and output the data currents corresponding to the one of the multiplexed data currents to the at least two of the data lines through an output terminal. The at least two of the data lines are coupled to pixels of the same color from among the plurality of pixels.

The pixels may include pixels of at least two colors, and the at least two of the data lines corresponding to one of the demultiplexers may be coupled to pixels of one color from among the pixels of at least two colors.

At least one of the sample/hold circuits may include: a sampling switch turned on during a sampling operation; a holding switch turned on during a holding operation; and a data storage element for storing data corresponding to one of the multiplexed data currents applied through the sampling switch during the sampling operation, and outputting one of the data currents through the holding switch during the holding operation.

The data storage element of the at least one of the sample/hold circuits may include a first transistor having a source and a drain respectively coupled to a first power source and a second power source through the switches, and a first capacitor coupled between a gate and the source of the first transistor. A voltage corresponding to the one of the multiplexed data currents applied through the sampling switch may be stored in the first capacitor.

The maximum value of one of the data currents programmed to the pixel of a first color from among the pixels of at least two colors may be greater than the maximum value of another one of the data currents programmed to the pixel of a second color. A ratio $W_1/L_1$ of a channel width $W_1$ and a channel length $L_1$ of the first transistor of the sample/hold circuit corresponding to the pixel of the first color may be greater than a ratio $W_2/L_2$ of a channel width $W_2$ and a channel length $L_2$ of the first transistor of the demultiplexer corresponding to the pixel of the second color.

The first transistor may be a p channel transistor, and the maximum value of one of the data currents programmed to the pixel of a first color from among the pixels of at least two colors may be greater than the maximum value of another one of the data currents programmed to the pixel of a second color. The voltage of the second power source of the sample/hold circuit corresponding to the pixel of the first color may be lower than the voltage of the second power source of the sample/hold circuit corresponding to the pixel of the second color.

The first transistor may be an n channel transistor, and the maximum value of one of the data currents programmed to the pixel of a first color from among the pixels of at least two colors may be greater than the maximum value of another one of the data currents programmed to the pixel of a second color. The voltage of the second power source of the sample/hold circuit corresponding to the pixel of the first color may be higher than the voltage of the second power source of the sample/hold circuit corresponding to the pixel of the second color.

The first transistor may be a p channel transistor, and the maximum value of one of the data currents programmed to the pixel of a first color from among the pixels of at least two colors may be greater than the maximum value of another one of the data currents programmed to the pixel of a second color. The voltage of the first power source of the sample/hold circuit corresponding to the pixel of the first color may be higher than the voltage of the first power source of the sample/hold circuit corresponding to the pixel of the second color.

The first transistor may be an n channel transistor, and the maximum value of one of the data currents programmed to the pixel of a first color from among the pixels of at least two colors may be greater than the maximum value of another one of the data currents programmed to the pixel of a second color. The voltage of the first power source of the sample/hold circuit corresponding to the pixel of the first color may be lower than the voltage of the first power source of the sample/hold circuit corresponding to the pixel of the second color.

The sampling switch may include a first switch coupled between the drain of the first transistor and the input terminal, a second switch for diode-connecting the first transistor when it is turned on, and a third switch coupled between the first power source and the first transistor. The holding switch may include a fourth switch coupled between the second power source and the first transistor, and a fifth switch coupled to the first transistor and the output terminal.

The third switch may be a transistor having the same conductivity as that of the first transistor, and the fourth switch is a transistor having conductivity opposite that of the first transistor.

At least one of the demultiplexers may include: first and second sample/hold circuits, each having an input terminal coupled to one of the signal lines, and each having an output terminal coupled to one of the at least two of the data lines; and a third sample/hold circuit and a fourth sample/circuit, each having an input terminal coupled to the one of the signal lines, and each having an output terminal coupled to another one of the at least two of the data lines.

The second and fourth sample/hold circuits may hold the data currents corresponding to stored data through the data lines while the first sample/hold circuit and third sample/circuit sample one of the multiplexed data currents applied through the one of the signal lines. The first and third sample/hold circuits may hold the data currents corresponding to stored data through the data lines while the second and fourth sample/hold circuits sample the one of the multiplexed data currents applied through the one of the signal lines.

At least one of the demultiplexers may include: a first sample/hold circuit having an input terminal coupled to one of the signal lines; a second sample/hold circuit having an input terminal coupled to an output terminal of the first sample/hold circuit, and having an output terminal coupled to one of the at least two of the data lines; a third sample/hold circuit having an input terminal coupled to the one of the signal lines; and a fourth sample/hold circuit having an input terminal coupled to an output terminal of the third sample/hold circuit, and having an output terminal coupled to one of the at least two of the data lines.

The second and fourth sample/hold circuits may concurrently hold the data currents through the data lines while the first and third sample/hold circuits sequentially sample the one of the multiplexed data currents applied through the one of the signal lines. The second and fourth sample/hold circuits may sample the data currents held by the first and third sample/hold circuits while the first and third sample/hold circuits hold the data currents corresponding to sampled data.

The pixels of at least two colors may each include: a second transistor for flowing one of the data currents transmitted through one of the data lines; a second capacitor coupled between a source and a gate of the second transistor for storing a voltage corresponding to the one of the data currents flowing to the second transistor; and a light emitting device for emitting light in correspondence to the one of the data currents flowing to the second transistor according to the voltage stored in the second capacitor.

The light emitting device may use electroluminescence of organic matter.

The maximum value of one of the data currents programmed to the pixel of a first color from among pixels of at least two colors may be greater than the maximum value of another one of the data currents programmed to the pixel of a second color. A ratio $W_3/L_3$ of a channel width $W_3$ and a channel length $L_3$ of the second transistor corresponding to the pixel of the first color may be greater than a ratio $W_4/L_4$ of a channel width $W_4$ and a channel length $L_4$ of the second transistor corresponding to the pixel of the second color.

The source of the second transistor may be coupled to a third power source, and the second transistor may be a p channel transistor. The maximum value of one of the data currents programmed to the pixel of the first color from among pixels of at least two colors may be greater than the maximum value of another one of the data currents programmed to the pixel of the second color from among the pixels of at least two colors. The voltage of the third power source corresponding to the pixel of the first color may be higher than the voltage of the third power source corresponding to the pixel of the second color.

The source of the second transistor may be coupled to a third power source, and the second transistor may be an n channel transistor. The maximum value of one of the data currents programmed to the pixel of the first color from among pixels of at least two colors may be greater than the maximum value of another one of the data currents programmed to the pixel of the second color from among the pixels of at least two colors. The voltage of the third power source corresponding to the pixel of the first color may be lower than the voltage of the third power source corresponding to the pixel of the second color.

In another aspect of the present invention, a display device includes: a display region including a plurality of pixels of a first color, a plurality of pixels of a second color, each of the pixels of the second color disposed between two adjacent ones of the pixels of the first color, and a plurality of data lines respectively coupled to the pixels of the first and second colors; a demultiplex unit including a plurality of first sample/hold circuit units respectively coupled to the data lines corresponding to the pixels of the first color, and a plurality of second sample/hold circuit units respectively coupled to the data lines corresponding to the pixels of the second color; and a data driver having an output terminal coupled to at least two sample/hold circuit units from among the first sample/hold circuit units and the second sample/hold circuit units through a signal line. The first sample/hold circuit unit samples a first data current for displaying an image of the first color applied from the data driver through the signal line, and outputs a current corresponding to the sampled first data current, and the second sample/hold circuit unit samples a second data current for displaying an image of the second color applied from the data driver through the signal line, and outputs a current corresponding to the sampled second data current.

The signal line may include a first signal line coupled to at least two first sample/hold circuit units from among the first sample/hold circuit units, and a second signal line coupled to at least two second sample/hold circuit units from among the second sample/hold circuit units.

The signal line may be coupled to at least one first sample/hold circuit unit from among the first sample/hold circuit units and at least one second sample/hold circuit unit from among the second sample/hold circuit units.

The first and second sample/hold circuit units may each include first and second sample/hold circuits having an input terminal coupled to the signal line and an output terminal coupled to one of the data lines, and the second sample/hold circuit may hold while the first sample/hold circuit samples, and the first sample/hold circuit may hold while the second sample/hold circuit samples.

The first and second sample/hold circuit units may each include a first sample/hold circuit having an input terminal coupled to the signal line, and a second sample/hold circuit having an input terminal coupled to an output terminal of the first sample/hold circuit. The first sample/hold circuit may sample the data applied through the signal line, and the second sample/hold circuit may sample the current held by the first sample/hold circuit and may hold the current corresponding to the sampled current to one of the data lines.

At least one of the first and second sample/hold circuits may include a sampling switch coupled to the input terminal and turned on during a sampling operation, a holding switch coupled to the output terminal and turned on during a holding operation, and a data storage element coupled between the sampling switch and the holding switch. The data storage element may include a transistor having a source and a drain respectively coupled to a first power source and a second power source through switches, and a capacitor coupled to a gate and the source of the transistor. The current may flow to the transistor during the sampling operation to store a voltage corresponding to the current applied through the sampling switch in the capacitor, and the current of the transistor may flow through the holding switch in correspondence to the voltage stored in the capacitor during the holding operation.

The maximum value of the first data current may be greater than the maximum value of the second data current, and a ratio $W_1/L_1$ of a channel width $W_1$ and a channel length $L_1$ of the transistor of the first sample/hold circuit unit may be greater than a ratio $W_2/L_2$ of a channel width $W_2$ and a channel length $L_2$ of the transistor of the second sample/hold circuit unit.

The transistor may be a p channel transistor, the maximum value of the first data current may be greater than the maximum value of the second data current, and the voltage of the second power source of the first sample/hold circuit unit may be lower than the voltage of the second power source of the second sample/hold circuit unit.

The transistor may be an n channel transistor, the maximum value of the first data current may be greater than the maximum value of the second data current, and the voltage of the second power source of the first sample/hold circuit unit may be higher than the voltage of the second power source of the second sample/hold circuit unit.

The transistor may be a p channel transistor, the maximum value of the first data current may be greater than the maximum value of the second data current, and the voltage of the first power source of the first sample/hold circuit unit may be higher than the voltage of the first power source of the second sample/hold circuit unit.

The transistor may be an n channel transistor, the maximum value of the first data current may be greater than the maximum value of the second data current, and the voltage of the first power source of the first sample/hold circuit unit may be lower than the voltage of the first power source of the second sample/hold circuit unit.

DETAILED DESCRIPTION

Figure 1:
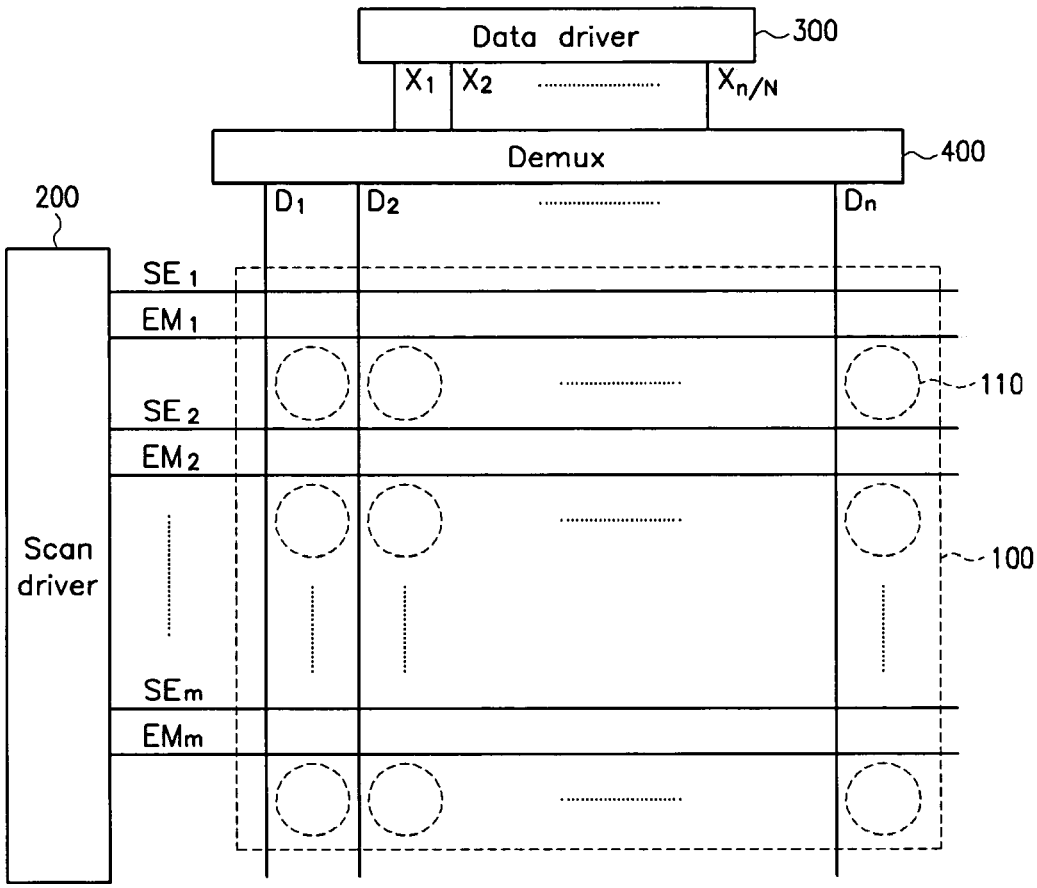
FIG. 1 shows a simplified diagram of a display device according to an exemplary embodiment of the present invention.

As shown in FIG. 1, the display device includes display region 100, scan driver 200, data driver 300, and demultiplex unit 400. A plurality of data lines $D_1$ to $D_n$, a plurality of select scan lines $SE_1$ to $SE_m$, a plurality of emit scan lines $EM_1$ to $EM_m$, and a plurality of pixels 110 are formed on display region 100. Data lines $D_1$ to $D_n$ are extended in a column direction, and transmit data currents for displaying images to the pixels. Select scan lines $SE_1$ to $SE_m$ and emit scan lines $EM_1$ to $EM_m$ are extended in a row direction, and respectively transmit select signals and emit signals to the pixels. Each pixel is formed at a region defined by two adjacent data lines and two adjacent select scan lines, and the pixel includes a transistor for transmitting the data current provided by data line $D_i$ in response to the select signal applied through select scan line $SE_j$, and a display element for showing gray in response to the data current transmitted by the transistor.

Scan driver 200 sequentially applies select signals and emit signals to select scan lines $SE_1$ to $SE_m$ and emit scan lines $EM_1$ to $EM_m$, and data driver 300 time-divides the data currents to generate time-divided (i.e., multiplexed) data currents, and applies the time-divided data currents to demultiplex unit 400. Demultiplex unit 400 demultiplexes the time-divided data currents provided by data driver 300, and applies the demultiplexed data currents to data lines $D_1$ to $D_n$. The number of signal lines $X_1$ to $X_{n/N}$ for transmitting the data currents to demultiplex unit 400 from data driver 300 is given as n/N when demultiplex unit 400 performs 1:N demultiplexing. That is, n/N signal lines $X_1$ to $X_{n/N}$ transmit the time-divided data currents that are demultiplexed by demultiplex unit 400 and applied to n data lines $D_1$ to $D_n$.

Display region 100 is formed on an insulation substrate. Scan driver 200 and demultiplex unit 400 can be connected to scan lines $SE_1$ to $SE_m$ and $EM_1$ to $EM_m$ and data lines $D_1$ to $D_n$ respectively formed on the insulation substrate. Alternatively, scan driver 200, data driver 300, and/or demultiplex unit 400 can be directly installed on the insulation substrate. In addition, scan driver 200, data driver 300, and/or demultiplex unit 400, and display region 100, can be formed on a panel by forming scan driver 200, data driver 300, and/or demultiplex unit 400 on the same layer as that used for forming scan lines $SE_1$ to $SE_m$ and $EM_1$ to $EM_m$, data lines $D_1$ to $D_n$, and the transistor of the pixel on the insulation substrate.

Demultiplex unit 400 will now be described in more detail with reference to FIGS. 2, 3, 4A, and 4B. Demultiplex unit 400 includes a plurality of demultiplexers each of which corresponds to one of the signal lines $X_1$ to $X_{n/N}$ and at least two of the n data lines $D_1$ to $D_n$. For ease of description, an exemplary demultiplex unit 400 provides 1:2 demultiplexing, and each demultiplexer corresponds to two data lines.

Figure 2:
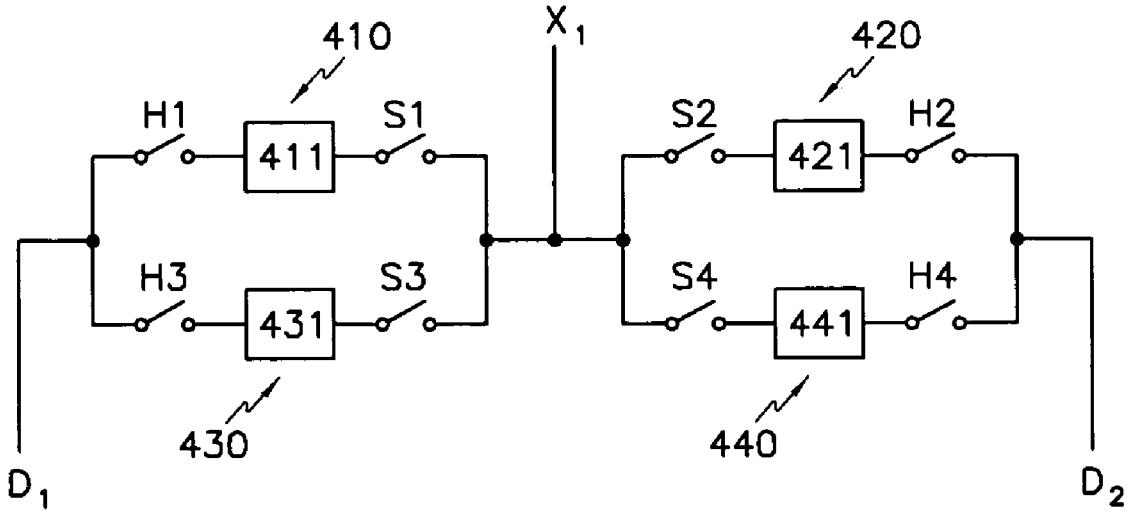
FIG. 2 shows a simplified diagram of a demultiplexer according to an exemplary embodiment of the present invention.

FIG. 2 shows a simplified diagram of a demultiplexer according to an exemplary embodiment of the present invention. As shown, the 1:2 demultiplexer includes four sample/hold circuits 410, 420, 430, 440 which respectively include sampling switches S1, S2, S3, S4, data storage elements 411, 421, 431, 441, and holding switches H1, H2, H3, H4. First terminals of sampling switches S1, S2, S3, S4 of sample/hold circuits 410, 420, 430, 440 are connected to data storage elements 411, 421, 431, 441, and first terminals of holding switches H1, H2, H3, H4 are connected to data storage elements 411, 421, 431, 441. Second terminals of sampling switches S1, S2, S3, S4 of sample/hold circuits 410, 420, 430, 440 are connected in common to signal line $X_1$. Second terminals of holding switches H1, H3 of sample/hold circuits 410, 430 are connected in common to data line $D_1$, and second terminals of holding switches H2, H4 of sample/hold circuits 420, 440 are connected in common to data line $D_2$. The terminals connected to signal line $X_1$ are referred to as input terminals, and the terminals connected to data lines $D_1$, $D_2$ are referred to as output terminals.

Respective sample/hold circuits 410, 420, 430, 440 sample the currents transmitted through sampling switches S1, S2, S3, S4 and store them in data storage elements 411, 421, 431, 441 in a voltage format when sampling switches S1, S2, S3, S4 are turned on, and they hold the currents corresponding to the voltages stored in data storage elements 411, 421, 431, 441 through holding switches H1, H2, H3, H4 when holding switches H1, H2, H3, H4 are turned on.

In this instance, 'to sample' is defined as to write the input current in the data storage element in the voltage format. In addition, 'to standby' is defined as to maintain the data written in the data storage element. Further, 'to hold' is defined as to output the current corresponding to the data written in the data storage element.

Next, an operation of the demultiplexer according to the exemplary embodiment of the present invention will be described with reference to FIGS. 3 and 4A to 4D.

Figure 3:
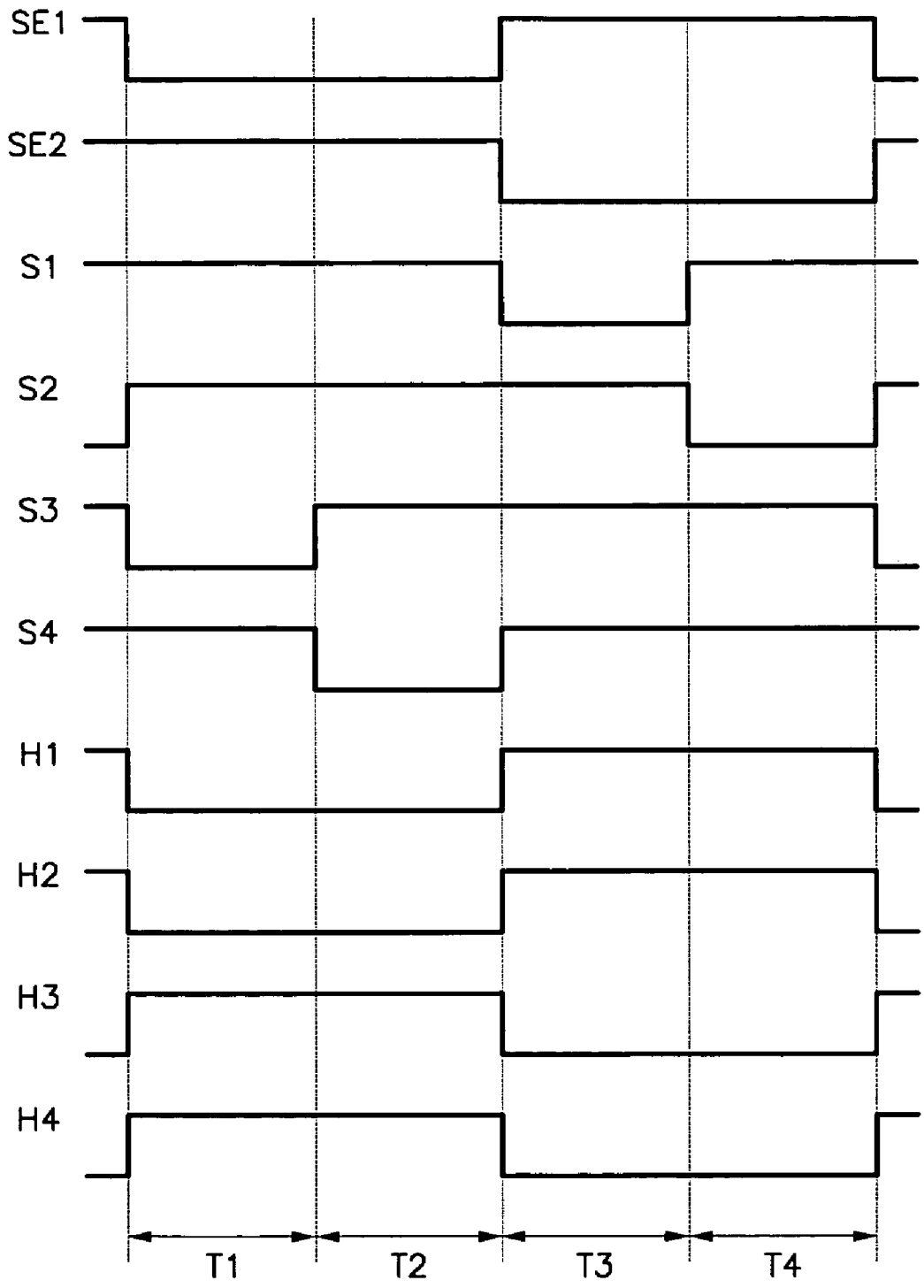
FIG. 3 shows a drive timing diagram of the demultiplexer shown in FIG. 2.

FIG. 3 shows a timing diagram of a switch of the demultiplexer, and FIGS. 4A to 4D show operations of the demultiplexer shown in FIG. 2 according to the timing diagram shown in FIG. 3. In FIG. 3, low levels indicate that the switches are turned on, and high levels depict that the switches are turned off.

Figure 4A:
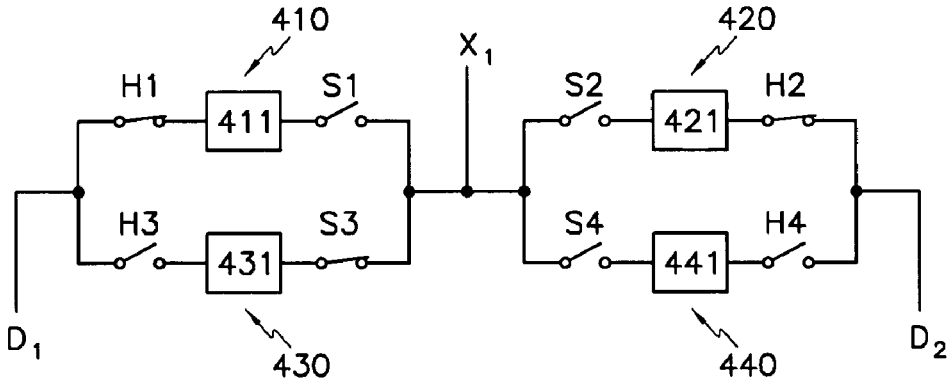
FIGS. 4A to 4D show operations of the demultiplexer shown in FIG. 2 according to time intervals shown in FIG. 3.

Referring to FIGS. 3 and 4A, sampling switch S3 and holding switches H1, H2 are turned on in interval T1. When sampling switch S3 is turned on, the data current applied through signal line $X_1$ is sampled to data storage element 431. When holding switches H1, H2 are turned on, the currents corresponding to the data respectively stored in data storage elements 411, 421 are held to data lines $D_1$, $D_2$. The sample/hold circuit with turned-off sampling switch S4 and holding switch H4 stays in the standby mode.

Figure 4B:
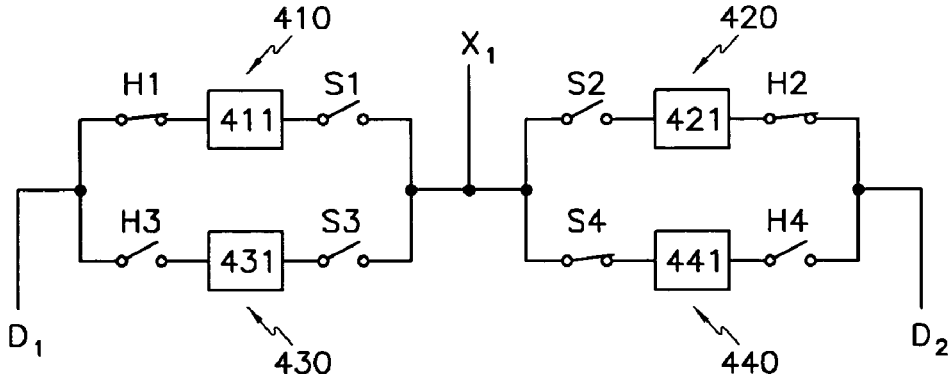

Referring to FIGS. 3 and 4B, sampling switch S3 is turned off and sampling switch S4 is turned on while holding switches H1, H2 are turned on in interval T2. The currents corresponding to the data stored in data storage elements 411, 421 are concurrently held to data lines $D_1$, $D_2$ since holding switches H1, H2 are turned on. When sampling switch S4 is turned on, the data current applied through signal line $X_1$ is sampled into data storage element 441.

Figure 4C:
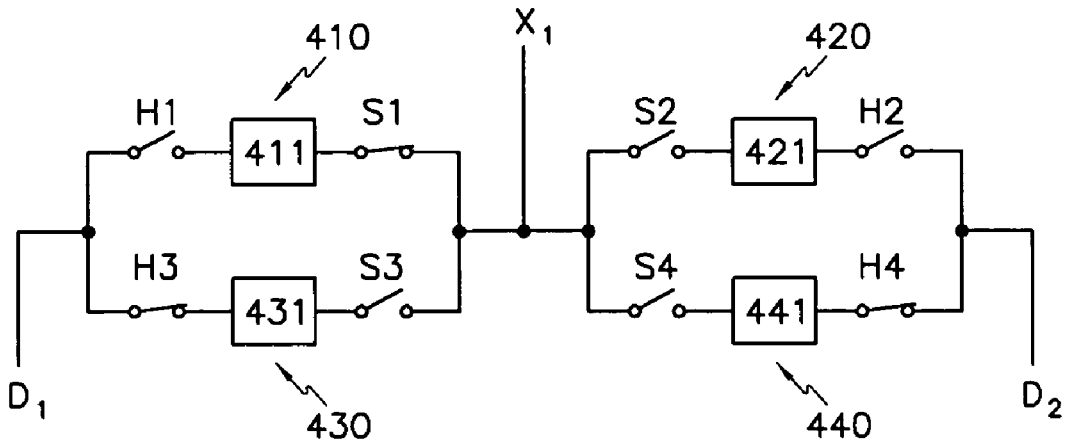

Referring to FIGS. 3 and 4C, sampling switch S4 and holding switches H1, H2 are turned off and sampling switch S1 and holding switches H3, H4 are turned on in interval T3. When sampling switch S1 is turned on, the data current applied through signal line $X_1$ is sampled into data storage element 411. When holding switches H3, H4 are turned on, the currents corresponding to the data respectively stored in data storage elements 431, 441 in intervals T1, T2 are held to data lines $D_1$, $D_2$.

Figure 4D:
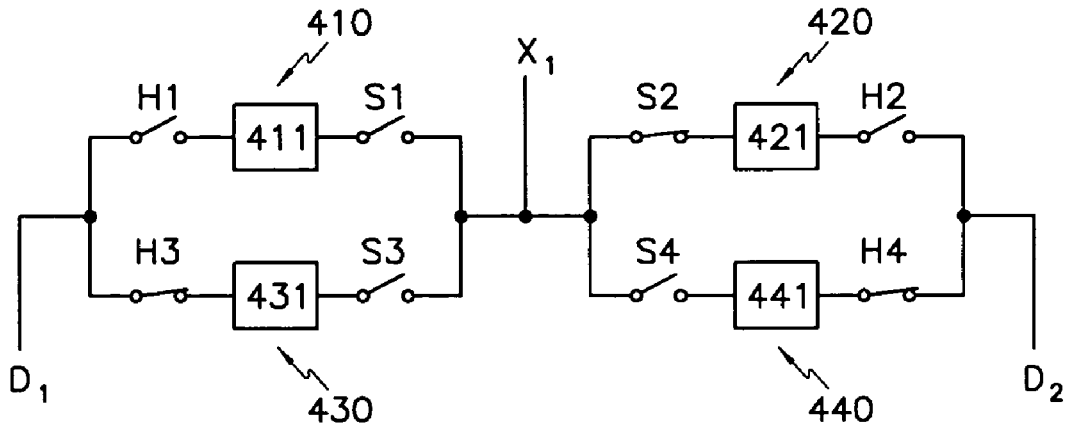

Referring to FIGS. 3 and 4D, sampling switch S1 is turned off and sampling switch S2 is turned on while holding switches H3, H4 are turned on in the interval T4. The currents corresponding to the data respectively stored in data storage elements 431, 441 are concurrently held to data lines $D_1$, $D_2$ since holding switches H3, H4 are turned on. When sampling switch S2 is turned on, the data current applied through signal line $X_1$ is sampled into data storage element 421.

In this instance, intervals T1, T2 correspond to a period (referred to as a "horizontal period" hereinafter) during which a pixel connected to a scan line on a row is turned on by a select signal, and intervals T3, T4 correspond to a subsequent horizontal period. The time for programming the data to the pixel is accordingly obtained since the data currents can be concurrently applied to the data lines $D_1$, $D_2$ during one horizontal period. The data currents can be transmitted to the data lines during one frame since the intervals T1 to T4 are repeated.

Since the four sample/hold circuits included in the demultiplexer of FIG. 2 can be realized in a substantially similar manner, only one sample/hold circuit 410 will be described with reference to FIGS. 5 to 7B.

Figure 5:
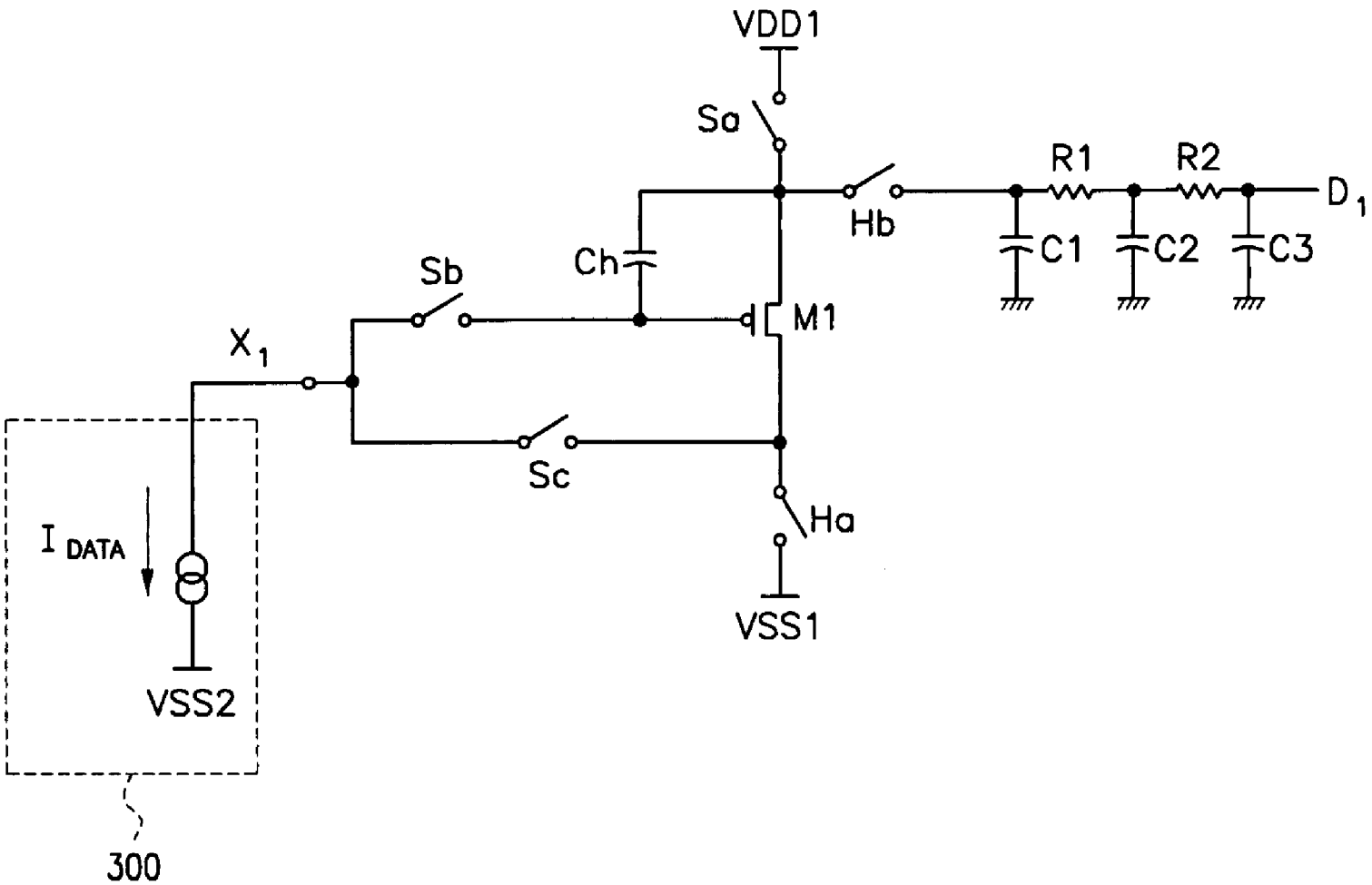
FIG. 5 shows an equivalent circuit diagram of a sample/hold circuit according to an exemplary embodiment of the present invention.
Figure 6A:
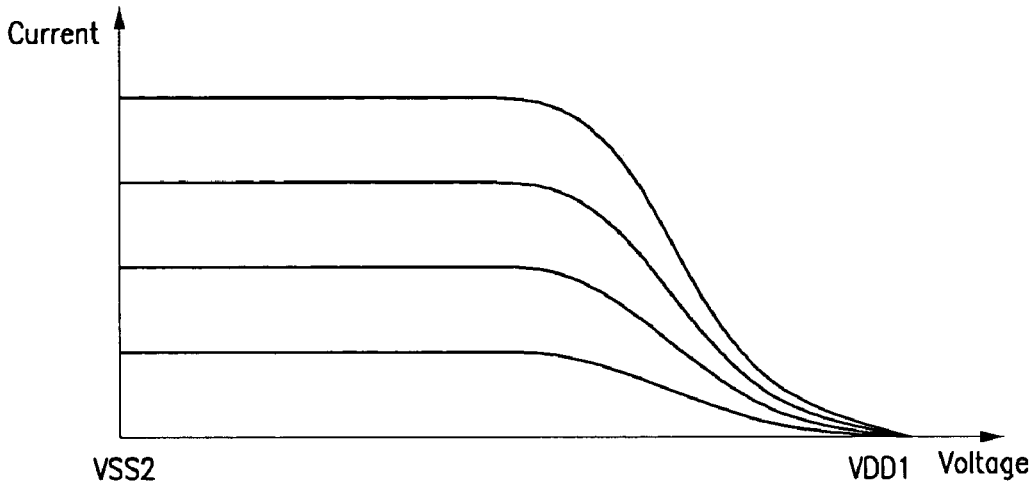
FIGS. 6A and 6B show current/voltage characteristic curves operational points at the time of sampling by the sample/hold circuit shown in FIG. 5.
Figure 6B:
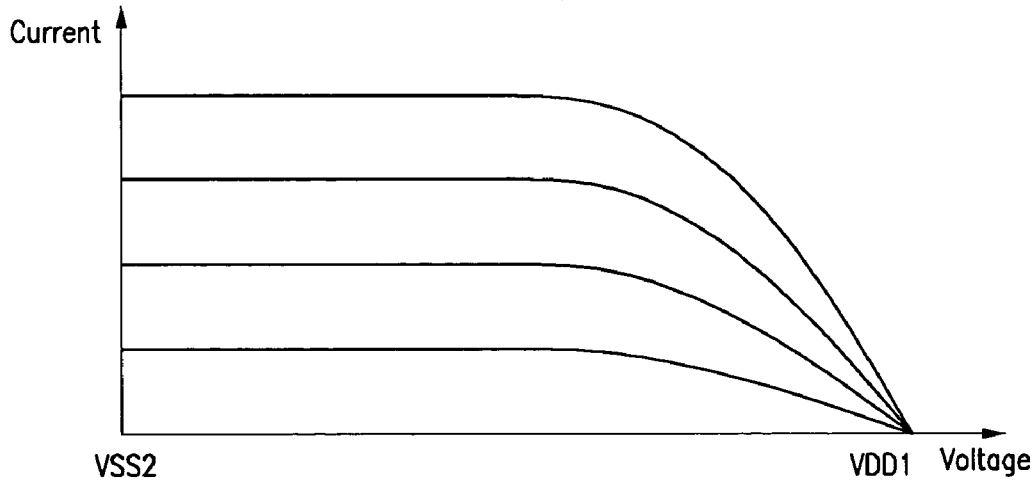
Figure 7A:
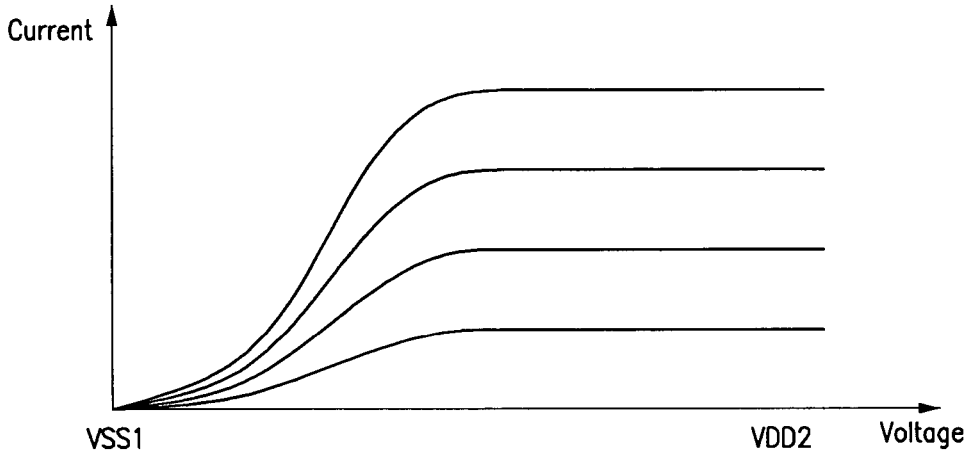
FIGS. 7A and 7B show current/voltage characteristic curves operational points at the time of holding by the sample/hold circuit shown in FIG. 5.
Figure 7B:
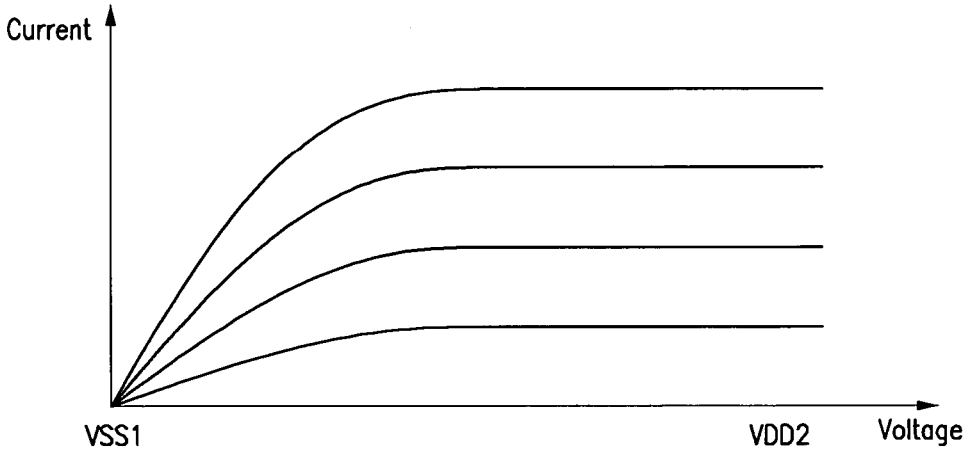

FIG. 5 shows an equivalent circuit diagram of the sample/hold circuit according to an exemplary embodiment of the present invention. FIGS. 6A and 6B show operational points at the time of sampling by the sample/hold circuit shown in FIG. 5. FIGS. 7A and 7B show operational points at the time of holding by the sample/hold circuit shown in FIG. 5.

As shown in FIG. 5, the sample/hold circuit is connected between signal line $X_1$ and data line $D_1$, and includes transistor M1, capacitor Ch, and five switches Sa, Sb, Sc, Ha, Hb. Data line $D_1$ is formed with parasitic resistance components and parasitic capacitance components. The parasitic resistance components are given as R1, R2, the parasitic capacitance components are given as C1, C2, C3, and transistor M1 is illustrated as a metal oxide semiconductor field-effect transistor (MOSFET).

Switch Sa is connected between power source voltage VDD1 and a source of transistor M1, and switch Ha is connected between a power source voltage VSS1 and a drain of transistor M1. Since transistor M1 is a p channel type, power source voltage VDD1 supplies a voltage which is higher -than power source voltage VSS1. Power source voltage VDD1 generally supplies a positive voltage, and power source voltage VSS1 generally supplies a negative voltage. Switch Sb is connected between signal line $X_1$ and a gate of transistor M1, and switch Hb is connected between the source of transistor M1 and data line $D_1$. Switch Sc is connected between signal line $X_1$ and the drain of transistor M1, and diode-connects transistor M1 when-switches Sb, Sc are turned on. Further, switch Sc can be connected between the gate and the drain of transistor M1 and diode-connects transistor M1.

Next, an operation of the sample/hold circuit shown in FIG. 5 will be described. Switches Sa, Sb, Sc are turned on and off with substantially the same timing, and switches Ha, Hb are also turned on and off with substantially the same timing.

When switches Sa, Sb, Sc are turned on and switches Ha, Hb are turned off, transistor M1 is diode-connected, current is supplied to capacitor Ch to charge it with a voltage, and the potential at the gate of transistor M1 is reduced to make the current flow to the drain from the source. When the c harged voltage at capacitor Ch is increased and the drain current of transistor M1 corresponds to data current $I_{DATA}$ provided by signal line $X_1$ as time is passed, the charged voltage at capacitor Ch is stopped and capacitor Ch is charged with a constant voltage. That is, the source-gate voltage $V_{SG}$ at transistor M1 is charged in capacitor Ch, the source-gate voltage $V_{SG}$ corresponding to the data current $I_{DATA}$ provided by signal line $X_1$. Accordingly, sample/hold circuit 410 samples the data current $I_{DATA}$ provided by signal line $X_1$.

When switches Sa, Sb, Sc are turned off and switches Ha, Hb are turned on, the current corresponding to the source-gate voltage $V_{SG}$ charged in capacitor Ch is transmitted to data line D, through switch Hb. Accordingly, sample/hold circuit 410 holds the current to data line $D_1$.

Sample/hold circuit 410 maintains the voltage charged in capacitor Ch since switches Sa, Sb, Sc, Ha, Hb are turned off while sample/hold circuit 420 of FIG. 2 performs sampling in interval T2. That is, sample/hold circuit 410 stays in the standby mode.

Since sample/hold circuit 410 performs sampling when switches Sa, Sb, Sc are turned on, switches Sa, Sb, Sc correspond to sampling switch S1 of FIG. 2. Since sample/hold circuit 410 performs holding when switches Ha, Hb are turned on, switches Ha, Hb correspond to holding switch H1 of FIG. 2. Since capacitor C1 and transistor M1 store the voltage corresponding to the data current, capacitor C1 and transistor M1 correspond to data storage element 411.

As a result, the timing of switches Sa, Sb, Sc substantially corresponds to the timing of sampling switch S1, while the timing of switches Ha, Hb substantially corresponds to the timing of holding switch H1, and the timing may be different because of delays in the circuits. Switches Sa, Sb, Sc are controlled by a single control signal or different control signals, and switches Ha, Hb are controlled by a single control signal or different control signals in a like manner. Switches Sa, Sb, Sc, Ha, Hb of FIG. 5 can be realized by p channel or n channel field effect transistors (FETs).

The sample/hold circuit in FIG. 5 acts as a source of the data current to signal line $X_1$ (i.e., the input terminal during the sampling operation), and sinks the data current from data line $D_1$ (i.e., the output terminal during the holding operation). Therefore, the sample/hold circuit in FIG. 5 can be used together with data driver 300 coupled to a power source voltage VSS2 for sinking the data current at signal line $X_1$ (i.e., the output terminal is a current sink type.) The cost of data driver 300 is reduced since the drive IC with the current sink type output terminal is inexpensive compared to the drive IC with the current source type output terminal.

In addition, when transistor M1 is realized by an n channel FET, and relative voltage levels of power source voltages VDD1, VSS1, a sample/hold circuit with a current sink type input terminal and a current source type output terminal is implemented. No corresponding description on the configuration such a sample/hold circuit will be provided since it is well known to a person skilled in the art.

In order to obtain a sufficient saturation region in the sampling operation of FIG. 5, switch Sa can be formed by the same conductivity as that of transistor M1. When switch Sa is an n channel type differing from transistor M1, voltage of VDD1 is applied to the gate of switch Sa in the sampling operation, and switch Sa is diode-connected. Accordingly, characteristic curves between the current and drain voltage at transistor M1 according to the source-gate voltage at transistor M1 are given in FIG. 6A. When switch Sa is a p channel type in the same manner as transistor M1, switch Sa is operated in the linear region in the sampling operation, and corresponding characteristic curves are illustrated in FIG. 6B. Referring to FIGS. 6A and 6B, the case of FIG. 6B has a wider voltage range of the operational point available by the same current than the case of FIG. 6A.

In the same manner, in order to obtain a sufficient saturation region in the holding operation of FIG. 5, switch Ha can be formed by the conductivity opposite that of transistor M1. When switch Ha has the same p channel type as that of transistor M1, voltage VSS1 is applied to the gate of switch Ha in the holding operation, and switch Ha is diode-connected. Accordingly, the characteristic curves between the current and the source voltage at transistor M1 according to the gate-source voltage at transistor M1 are given in FIG. 7A. When switch Ha is an n channel type, switch Ha is operated in the linear region in the holding operation, and corresponding characteristic curves given as FIG. 7B. Voltage VDD2 in FIGS. 7A and 7B is a power source voltage connected by data line $D_1$ through a pixel in the holding operation. Referring to FIGS. 7A and 7B, the case of FIG. 7B has a wider voltage range of the operational point available by the same current than the case of FIG. 7A.

Figure 8:
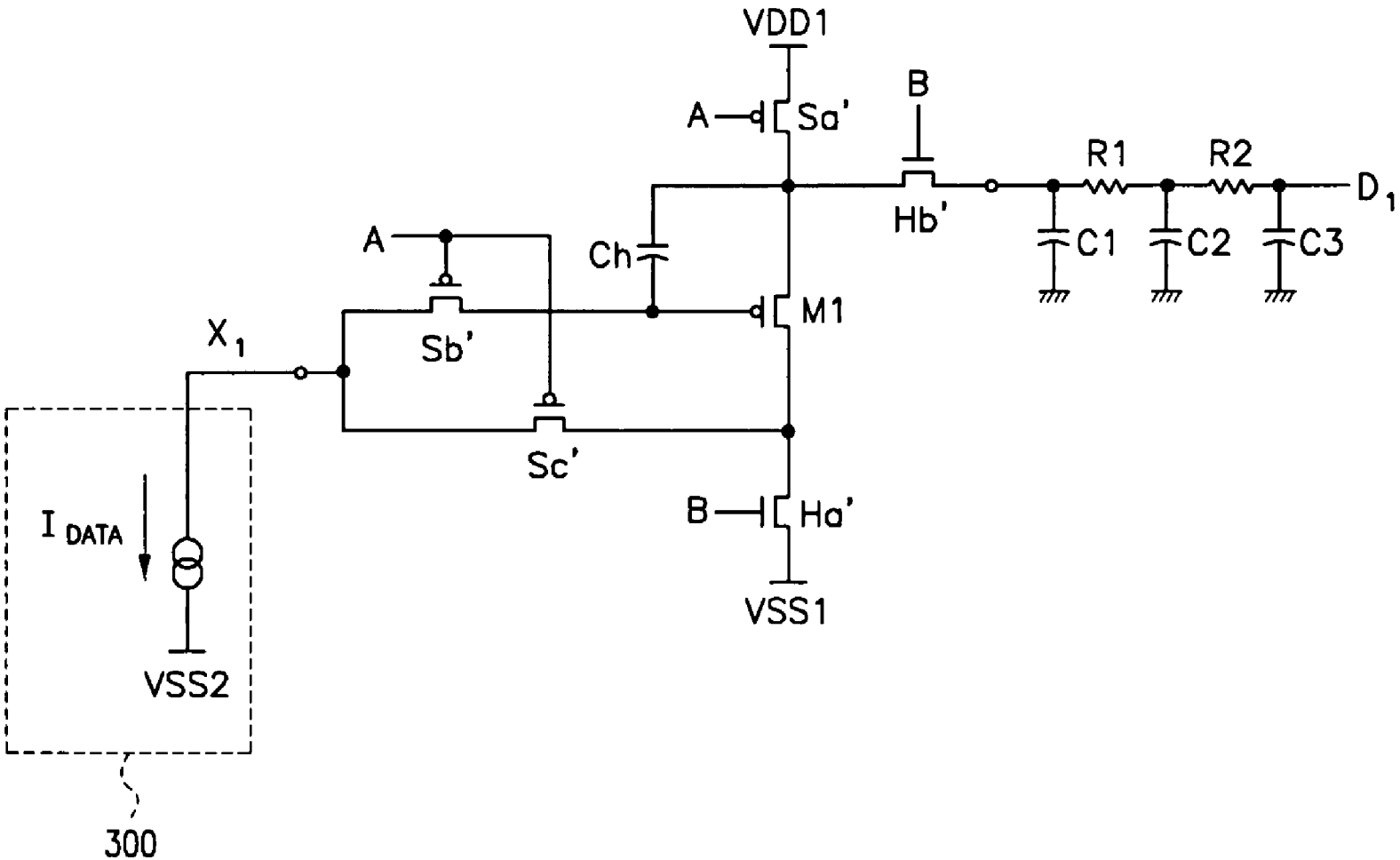
FIG. 8 shows an equivalent circuit diagram of the sample/hold circuit shown in FIG. 5 having a sampling switch realized by a p channel transistor and a holding switch realized by an n channel transistor.

FIG. 8 shows the sample/hold circuit shown in FIG. 5 wherein switches Sa', Sb', Sc' are realized by p channel transistors and switches Ha', Hb' are realized by n channel transistors. When switches Sa', Ha' are formed by p channel and n channel transistors respectively, switches Sb', Sc' which are turned on in the sampling operation are formed by p channel transistors, and switch Hb' which is turned on in the holding operation is formed by an n channel transistor in order to control the sampling and the holding by a single control signal respectively. Referring to FIG. 8, switches Sa', Sb', Sc' are controlled by a control signal A, and switches Ha', Hb' are controlled by a control signal B.

Next, referring to FIGS. 9 and 10, a display device including a demultiplexer using a sample/hold circuit will be described.

Figure 9:
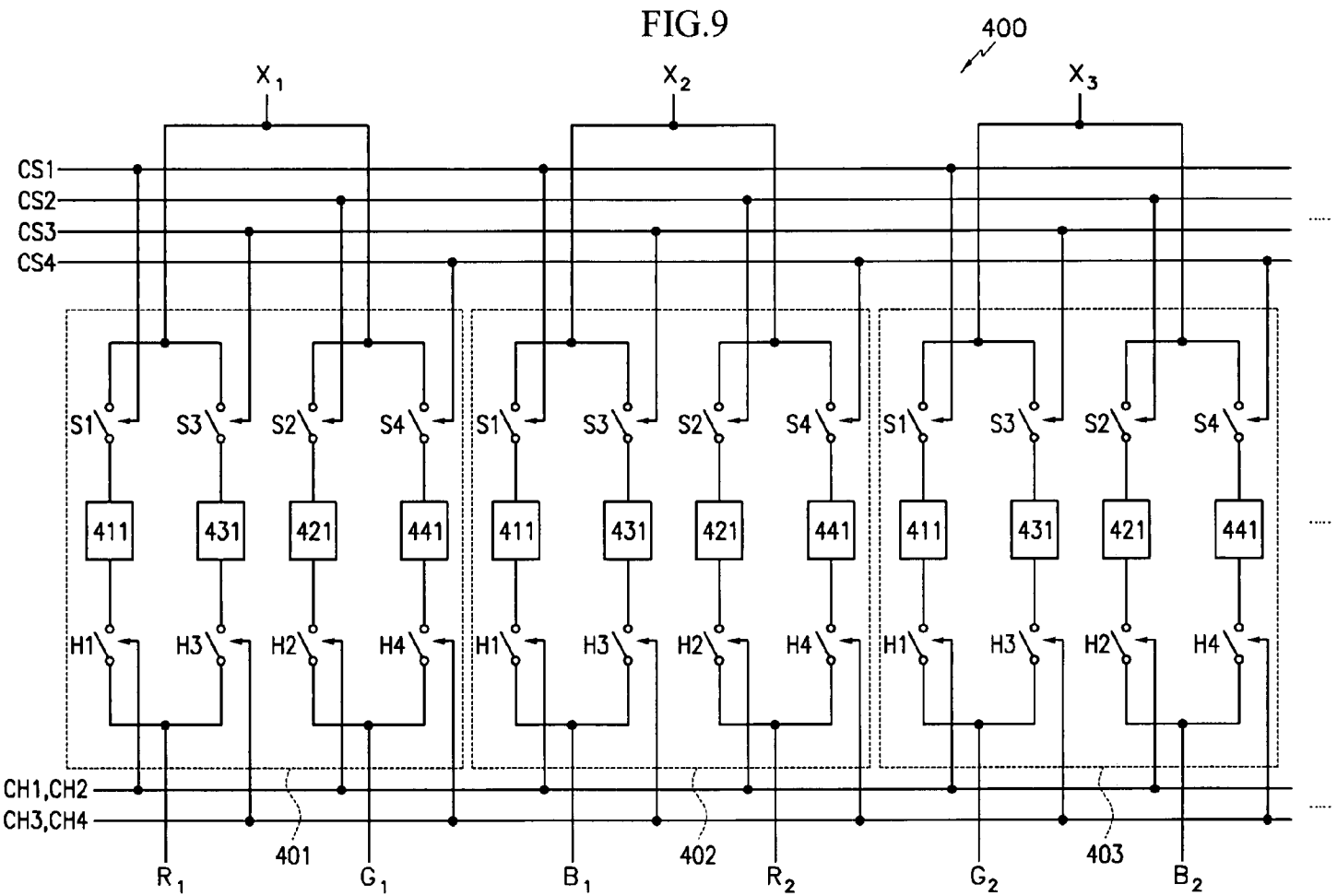
FIGS. 9 and 10 show connection states of the demultiplexing unit of the display device and the data lines according to first and second exemplary embodiments of the present invention.
Figure 10:
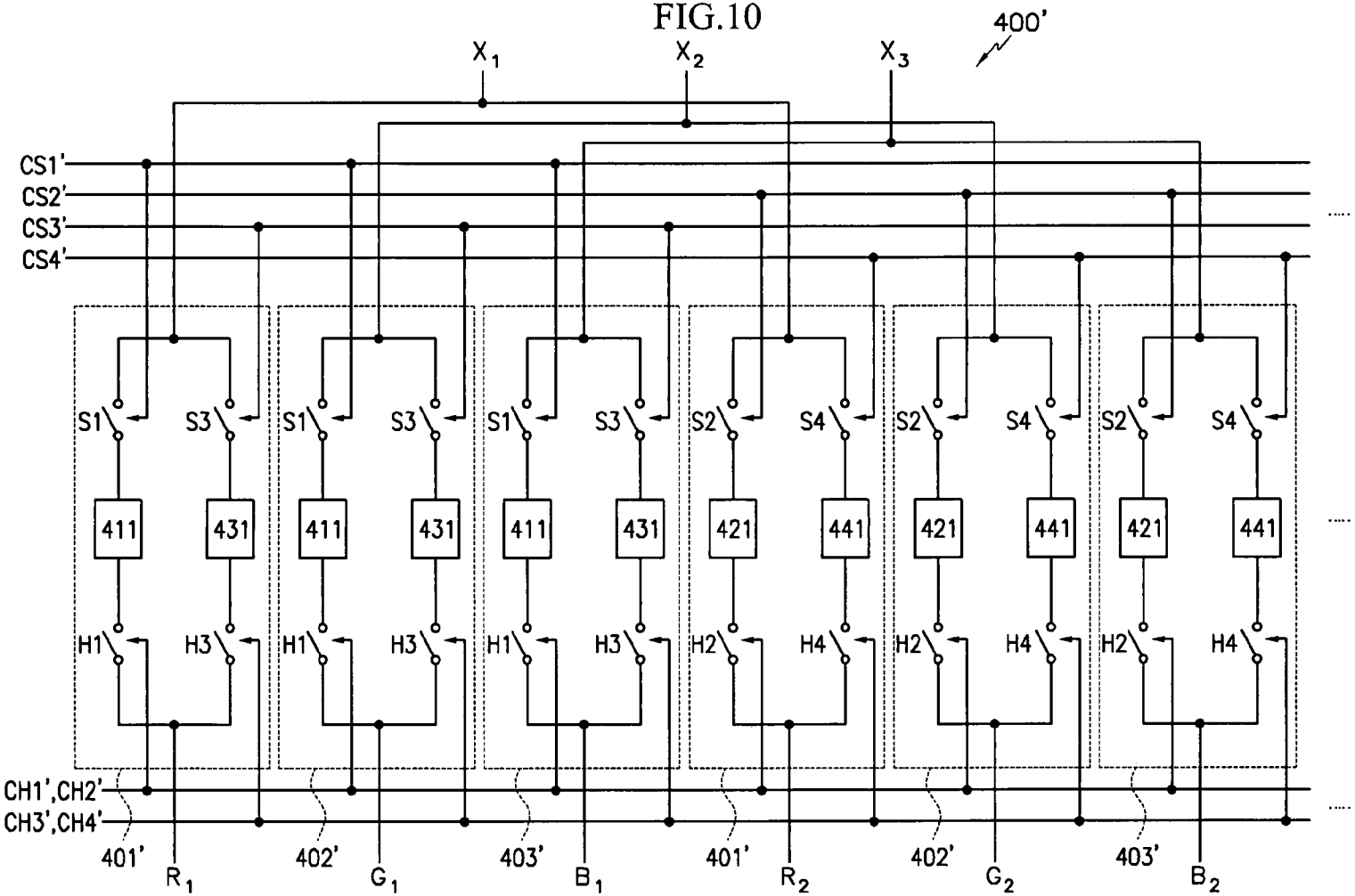

FIGS. 9 and 10 show connection states of the demultiplexing unit of the display device and the data lines according to first and second exemplary embodiments of the present invention. Red, green, and blue pixels are alternately arranged in the row direction, and the same color pixels are arranged in the column direction, and the data lines connected to the red, green, and blue pixels are given as $R_i$, $G_i$, and $B_i$. It is assumed therein for ease of description that two red, green, and blue pixels are respectively arranged in the row direction, and more than two red, green, and blue pixels are connected in the same pattern as those of FIGS. 9 and 10.

Referring to FIG. 9, in demultiplex unit 400 according to the first exemplary embodiment of the present invention, output terminals of demultiplexer 401 having the input terminals connected to signal line $X_1$ are connected to data lines $R_1$, $G_1$, output terminals of demultiplexer 402 having the input terminals connected to signal line $X_2$ are connected to data lines $B_1$, $R_2$, and output terminals of demultiplexer 403 having the input terminals connected to signal line $X_3$ are connected to data lines $G_2$, $B_2$. Sampling switches S1, S2, S3, S4 of respective demultiplexers 401, 402, 403 are controlled by separate signal lines CS1, CS2, CS3, CS4, holding switches H1, H2 are controlled by common signal line CH1, CH2, and holding switches H3, H4 are controlled by common signal line CH3, CH4.

Since the red, green, and blue pixels generally require different current ranges for representing grays, when data driver 300 establishes an operational voltage range of the current of a single output terminal as a current range which corresponds to a single color, the currents which correspond to pixels of other colors may not be normally output in the corresponding operational voltage range. Therefore, inappropriate gray scales may be represented on the pixel of one color when the pixels of two colors are connected to one output terminal as shown in FIG. 9. Hence, it is desirable to allocate the respective signal lines $X_i$ to the pixels of the same color through the demultiplexer as shown in FIG. 10.

Referring to FIG. 10, in demultiplex unit 400' according to the second exemplary embodiment of the present invention, output terminals of demultiplexer 401' having the input terminals connected to signal line $X_1$ are connected to data lines $R_1$, $R_2$ of the red pixel, output terminals of demultiplexer 402' having the input terminals connected to signal line $X_2$ are connected to data lines $G_1$, $G_2$ of the green pixel, and output terminals of demultiplexer 403' having the input terminals connected to signal line $X_3$ are connected to data lines $B_1$, $B_2$ of the blue pixel. That is, the respective demultiplexers are connected to the data line of the pixels of the same color.

Since the respective signal lines $X_i$ of data driver 300 accordingly transmit the data currents corresponding to the pixels of the same color, the red, green, and blue pixels have their current ranges.

The sample/hold circuits appropriate for the pixels of the respective colors can be manufactured according to the methods described with reference to FIGS. 9 and 10 since the pixels have different light emission efficiency and available current ranges according to colors. Conditions of the sample/hold circuits will be described with reference to FIGS. 12 and 13 by exemplifying a case in which the pixel circuit of FIG. 11 is formed at the pixel of the display devices which include the demultiplexers illustrated on FIGS. 9 and 10.

Figure 11:
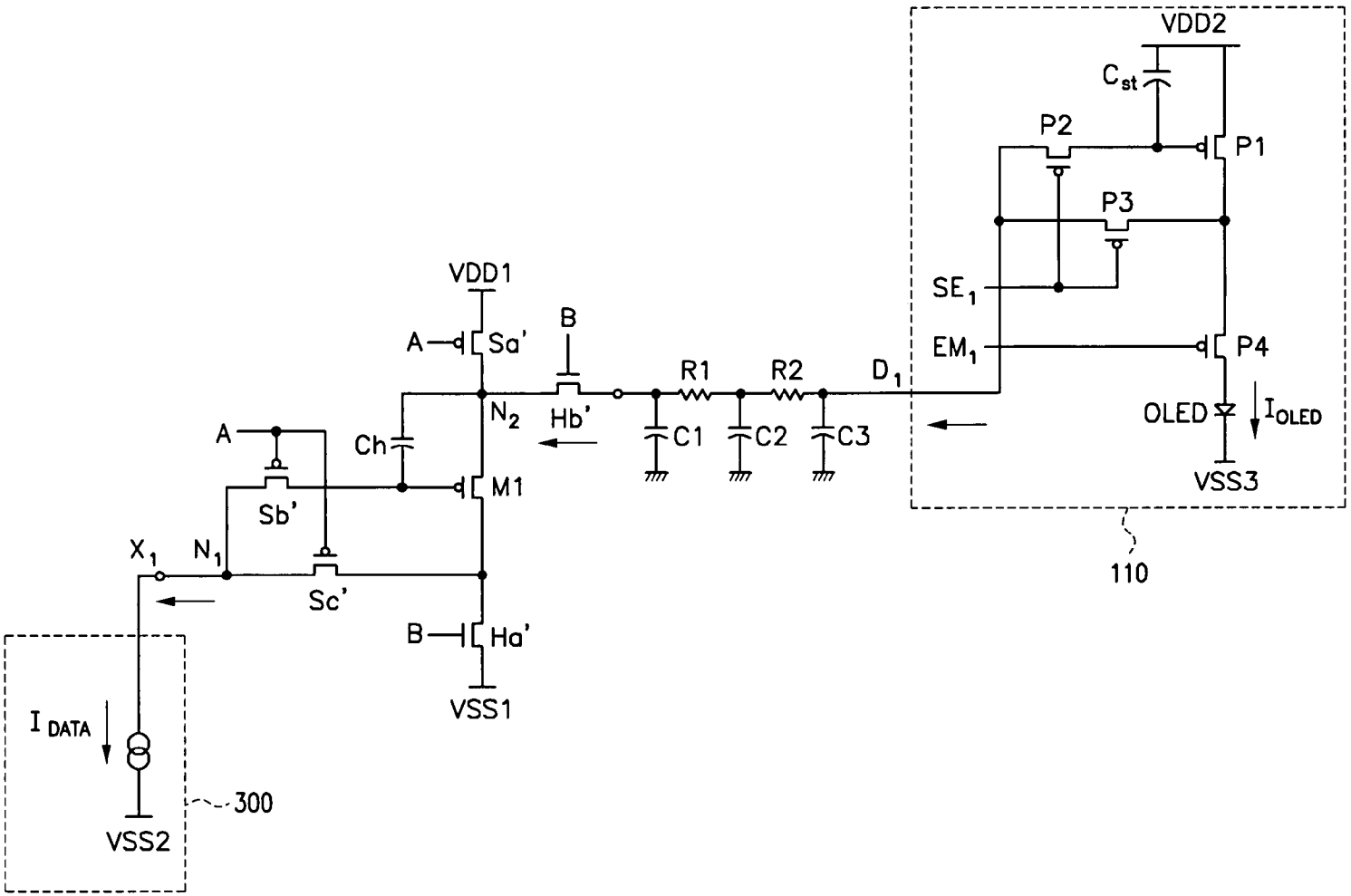
FIG. 11 shows an equivalent circuit diagram of a circuit for coupling a sample/hold circuit to a pixel circuit.
Figure 12:
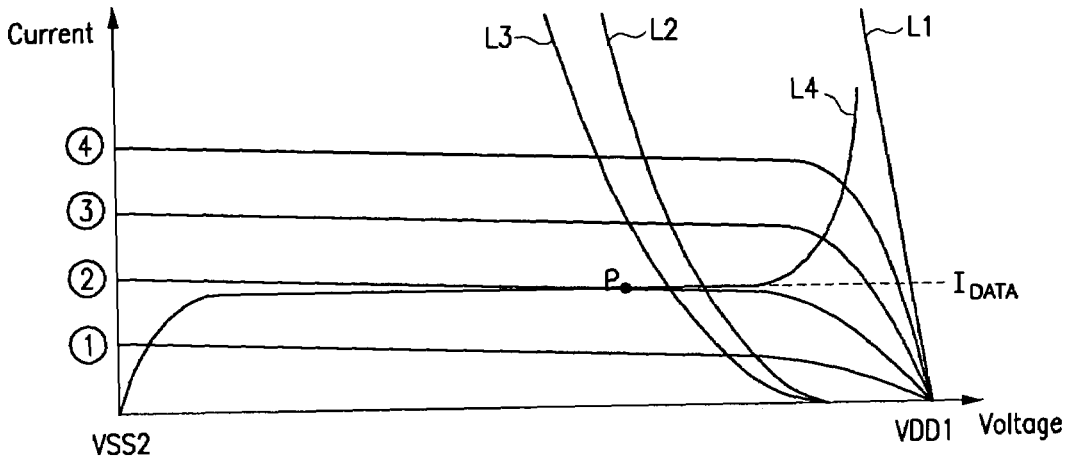
FIGS. 12 and 13 show current/voltage characteristic curves operational points at the time of sampling and holding by the sample/hold circuit shown in FIG. 11.
Figure 13:
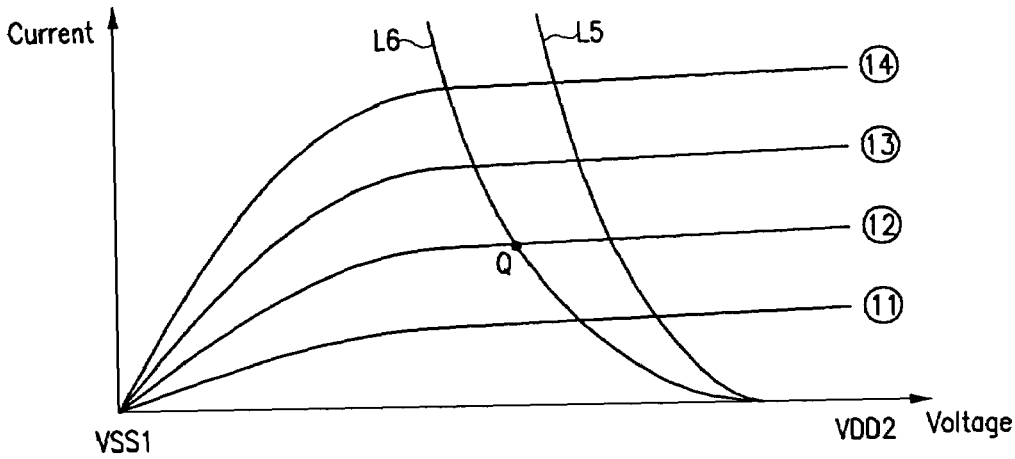

FIG. 11 shows an equivalent circuit diagram of a circuit for connecting a sample/hold circuit to a pixel circuit, and FIGS. 12 and 13 show operational points at the time of sampling and holding by the sample/hold circuit shown in FIG. 11.

Referring to FIG. 11, pixel circuit 110 is connected to the sample/hold circuit of FIG. 8, and uses electroluminescence of organic matter. The data are programmed to pixel circuit 110 by the current. Pixel circuit 110 includes four transistors P1, P2, P3, P4, capacitor Cst, and an organic light emitting diode (OLED). Transistors P1, P2, P3, P4 are illustrated as p channel FETs.

A source of transistor P1 is connected to a power source voltage VDD2, and capacitor Cst is connected between the source and gate of transistor P1. Transistor P2 is connected between data line $D_1$ and the gate of transistor P1, and responds to a select signal provided by select scan line $SE_1$. Transistor P3 is connected between a drain of transistor P1 and data line $D_1$, and diode-connects transistor P1 together with transistor P2 in response to the select signal provided by select scan line $SE_1$. Transistor P4 is connected between the drain of transistor P1 and the OLED, and transmits the current provided by transistor P1 to the OLED in response to an emit signal provided by emit scan line $EM_1$. A cathode of the OLED is connected to power source voltage VSS3 which is lower than power source voltage VDD2.

In this instance, when transistors P2, P3 are turned on according to the select signal provided by select scan line $SE_1$, the current provided by data line $D_1$ flows to the drain of transistor P1, and the source-gate voltage at transistor P1 corresponding to the current is stored in capacitor Cst. When the emit signal is applied from emit scan line $EM_1$, transistor P4 is turned on, current $I_{OLED}$ of transistor P1 corresponding to the voltage stored in capacitor Cst is supplied to the OLED, and the OLED emits light according to the current.

Next, an operational point of the sample/hold circuit when the pixel circuit is connected to the sample/hold circuit through the data line as shown in FIG. 11 will be described. As described above, the characteristic curves between the current and the drain voltage of transistor M1 according to the source-gate voltage at transistor M1 at the sampling operation are given as ①, ②, ③ and ④ of FIG. 12. In this instance, the respective characteristic curves ①, ②, ③, and ④ correspond to different source-gate voltages of transistor M1. Curves L1, L2 respectively show relationship between the currents flowing through transistors Sa', M1 and corresponding voltage dropping through transistors Sa', M1 by fixing the source voltage as power source voltage VDD1. Since transistors Sa', Sc' have large source-gate voltages and are operated in the linear region, the voltage drops through transistors Sa', Sc' are substantially the same, and accordingly, the voltage dropping curve of transistor Sb' is given in almost the same manner as curve L1.

The voltage at node N1 in FIG. 11 is a voltage dropped from power source voltage VDD1 through transistors Sa', M1, Sc', and the relationship between the current flowing through transistors Sa', M1, Sc' and the voltage drop through transistors Sa', M1, Sc' is given as a curve L3. Hence, with respect to a random current value, curve L3 is obtained by subtracting the summation of twice the distance of between curve L1 and power source voltage VDD1 and the distance of between curve L2 and power source voltage VDD1 from power source voltage VDD1. That is, as shown in FIG. 12, curve L3 has a form of curve L2 leaning to the left. The operational point at the sampling operation is determined on the crossing point where curve L3 and the characteristic curve L4 of the current versus the voltage at the output terminal of the data driver 300 meet. The current at the output terminal of data driver 300 has a substantially constant value within a predetermined operational voltage range as shown by curve L4. When the output terminal of data driver 300 outputs the current which corresponds to the current of $I_{DATA}$, the operational point is determined at the point P.

When the operational point is determined to be P, the source-gate voltage which corresponds to curve ② which is passed through operational point P is stored in capacitor Cst, and operational point P is provided in the saturation region of curve ②.

Next, when the characteristic curves of the current versus the source voltage of transistor M1 according to the source-gate voltage of transistor M1 at the holding operation are illustrated as ⑪, ⑫, ⑬, and ⑭ of FIG. 13, the source-gate voltages of the respective characteristic curves ⑪, ⑫, ⑬, and ⑭ correspond to the source-gate voltages of curves ①, ②, ③, and ④ of FIG. 12. Accordingly, the characteristic curve of the current versus the source voltage of transistor M1 follows curve ⑫ at the holding operation.

Curve L5 of FIG. 13 depicts the relationship between the current flowing through transistor Hb' and data line $D_1$ and the corresponding voltage dropping through transistor Hb' and data line $D_1$ by fixing the voltage at the connecting point of data line $D_1$ and pixel circuit 110 by power source voltage VDD2. When the voltage dropping through transistors P1, P3 is added to curve L5 in the same manner as in FIG. 12, curve L6 for showing the relationship of between the current flowing through transistors P1, P3, data line $D_1$, and transistor Hb' and the voltage at node N2 which is the source of transistor M1 is found from power source voltage VDD2. Since the current of curve L6 corresponds to the current flowing to transistor M1, operational point Q at the holding operation is determined on the crossing point of the characteristic curve ⑫ and curve L6.

The characteristic curves ⑪, ⑫, ⑬, and ⑭ of FIG. 13 have forms obtained by symmetrically moving the characteristic curves ①, ②, ③, and ④ of FIG. 12 and adding the voltage dropping at transistor Ha' to them. Therefore, operational point P is considered to have moved along curve ② at the holding operation after the sampling operation. That is, the source-drain voltage at transistor M1 is changed in the holding operation after the sampling operation.

As shown in FIGS. 12 and 13, the current in the saturation region is not constant, is increased according to voltages, and has different slopes of the current according to characteristic distribution of transistor M1 in the actual characteristic curves. The current ID of the transistor in the saturation region is approximated as given in Equation 1.

$$I_D = \frac{1}{2}\mu C_{ox}\frac{W}{L}(V_{SG} + V_{TH})^2(1 + \lambda V_{SD}) \qquad \text{Equation 1}$$

where μ is a mobility of carriers, $C_{ox}$ is capacitance of an oxide film, $V_{SG}$ is a source-gate voltage, $V_{TH}$ is a threshold voltage, λ is a constant, and $V_{SD}$ is a source-drain voltage.

Therefore, the current at the holding operation is varied according to characteristics of transistor M1 when the same current is sampled, and as given in Equation 1, the deviation becomes greater as the ratio W/L of the channel width W and the channel length L of transistor M1 increases. Therefore, the deviation of the holding current according to the characteristic deviation is reduced as the ratio W/L of the channel width W and the channel length L of transistor M1 is reduced.

In the case of using the pixels of organic electroluminescence as exemplified in FIG. 11, the deviation of the holding current applied to the green pixel is substantially lessened since the light emission efficiency of the organic matter for displaying green is three to four times greater than the light emission efficiency of the organic matter for displaying blue. That is, it is required to minimize the ratio W/L of the channel width W and the channel length L of transistor M1 of the sample/hold circuit connected to the data line of the green pixel with the best light emission efficiency.

Also, when the ratio W/L of the channel width W and the channel length L of transistor M1 is small, the slope of curve L3 is reduced in FIG. 12, and the voltage range of operational point P which moves along the data current $I_{DATA}$ is increased. Since the current range used for the pixels of the blue organic matter is approximately 2.5 times greater than the current range used for the green organic matter, operational point P may digress from the operational voltage region of the output terminal of data driver 300 shown in FIG. 12 when the sample/hold circuit optimized for the pixels of the green organic matter is used to the pixel of the blue organic matter.

Accordingly, power source voltage VDD1 is increased, or the ratio W/L of the channel width W and the channel length L of transistor M1 is increased in the sample/hold circuit applied to the pixel of the blue organic matter with a large range of the data current. When power source voltage VDD1 is increased, the curves in FIG. 12 are moved to the right, and the moving range of operational point P is extended. In this case, the controllable range is limited and power consumption is increased since the minimum value of the data current to be processed is increased, and costs are increased since the sample/hold circuit applied to the blue pixel uses another power source. When the ratio W/L of the channel width W and the channel length L is increased, the voltage range for forming operational point P is narrowed, and operational point P is formed within the operational voltage range of the output terminal of data driver 300. In this instance, since the deviation of the holding current may be larger as given in Equation 1, the above-described two conditions may be combined and used.

Next, operational point Q in the saturation region of the characteristic curve of transistor M1 is established over the whole data current range at the holding operation. Since the deviation of the holding current applied to the green pixel with high light emission efficiency is substantially lessened, the ratio W/L of the channel width W and the channel length L of transistor M1 of the sample/hold circuit connected to the data line of the green pixel is minimized.

Also, when the ratio W/L of the channel width W and the channel length L of transistor M1 is small, the operational point Q may digress from the saturation region of the characteristic curve of transistor M1. In order to solve this problem, proposed are a method for increasing the ratio W/L of the channel width W and the channel length L of transistor M1, a method for reducing power source voltage VSS1, a method for increasing power source voltage VDD2, and a method for increasing the ratio W/L of the channel width W and the channel length L of transistor P1.

First, since the slope of the linear region is large when the ratio W/L of the channel width W and the channel length L of transistor M1 is large, and the slope of the linear region is small when the ratio W/L of the channel width W and the channel length L of transistor M1 is small, the starting point of the saturation region is moved to the left by using transistor M1 with a large ratio W/L of the channel width W and the channel length L.

Second, when power source voltage VSS1 is reduced, the starting point of the characteristic curve of transistor M1 is moved to the left in FIG. 13, the starting point of the saturation region is moved to the left, and accordingly, the range of the saturation region where operational point Q may move is increased.

Third, when power source voltage VDD2 is increased, the apex of curve L6 is moved to the right, and operational point Q is moved to the right and formed so that operational point Q may move in the saturation region.

Fourth, when the ratio W/L of the channel width W and the channel length L of the transistor P1 is large, the slope of curve L6 is increased, and the operational point Q is moved to the right so that the operational point Q may move in the saturation region.

In summary of the above description, the sample/hold circuit of the demultiplexer connected to the pixel of the color using the data current with the large maximum current uses transistor M1 with the large ratio W/L of the channel width W and the channel length L, uses the low power source voltage VSS1, uses high power source voltages VDD1 and VDD2, or uses transistor P1 with the large ratio W/L of the channel width W and the channel length L.

The above-described conditions are satisfied when transistor M1 is a p channel type, and the sample/hold circuit of the demultiplexer connected to the pixel of the color using the data current with the big maximum current uses high power source voltage VSS1 or uses low power source voltages VDD1, VDD2 when transistors M1, P1 are n channel transistors.

In the above, the demultiplexer connected to the sample/hold circuit has been described as shown in FIG. 2, and in addition, the exemplary embodiment can further be applied to the demultiplexer connected in a different format to the sample/hold circuit.

Figure 14:
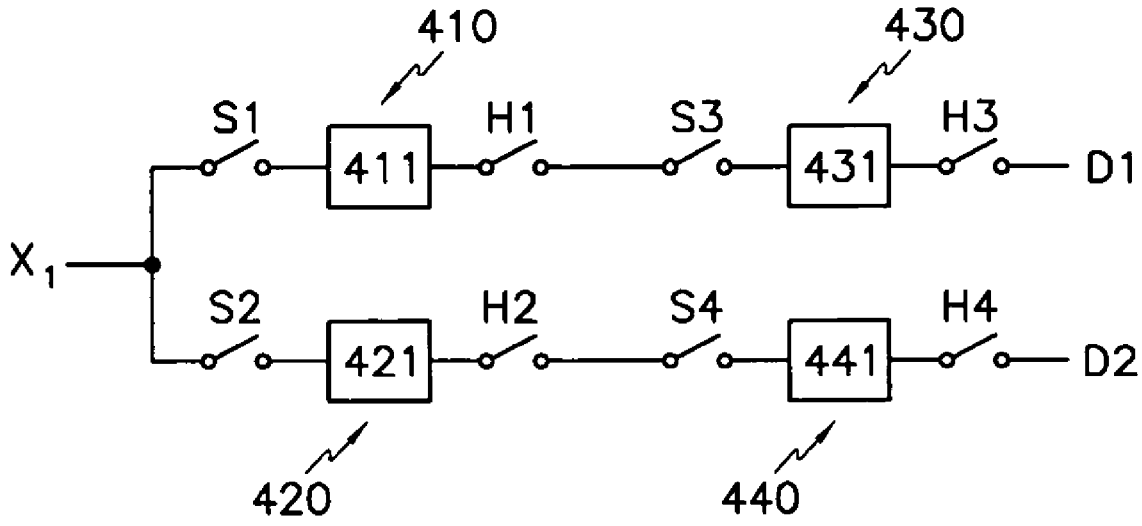
FIG. 14 shows a simplified diagram of a demultiplexer according to another exemplary embodiment of the present invention.
Figure 15:
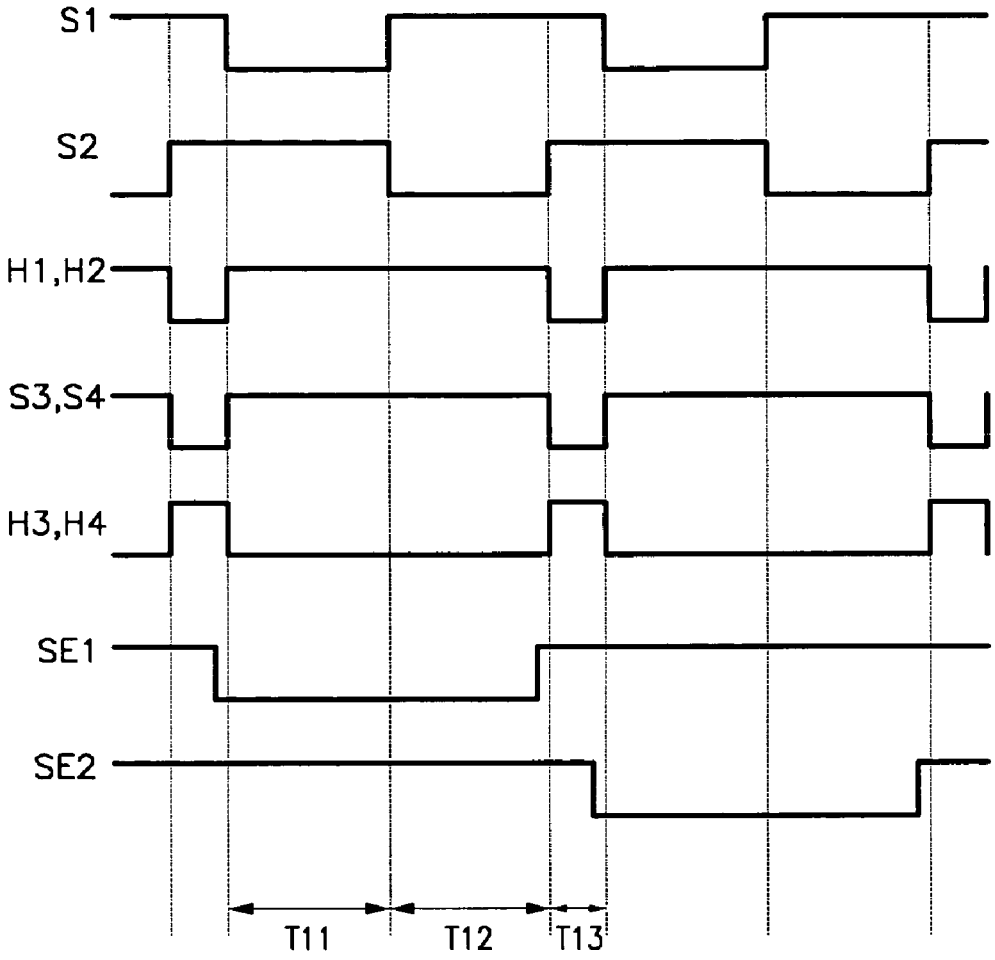
FIG. 15 shows a drive timing diagram of the demultiplexer shown in FIG. 14.

For example, sample/hold circuits 410, 430 are connected in series and sample/hold circuits 420, 440 are connected in series in a 1:2 demultiplexer, as shown in FIG. 14. Referring to FIG. 15, sample/hold circuit 410 samples the current applied through signal line $X_i$, and sample/hold circuits 430, 440 hold the current through data lines $D_1$, $D_2$ during interval T11. Sample/hold circuit 420 samples the current applied through signal line $X_i$, and sample/hold circuits 430, 440 hold the current through data lines $D_1$, $D_2$ during interval T12. Sample/hold circuits 410, 420 hold the current, and sample/hold circuits 430, 440 sample the held current and store data during interval T13. Intervals T11, T12, T13 respectively correspond to one horizontal period, and they are repeated to perform the demultiplexing operation.

As described, different current levels are used for the pixels of different colors. A sufficient saturation region is obtainable from a demultiplexer which uses a high level current. The number of data drive ICs is reduced by using the sample/hold circuits without reducing the data programming time.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a display region having a plurality of data lines for transmitting data currents for displaying images, a plurality of scan lines for transmitting select signals, and a plurality of pixels for displaying the images corresponding to the data currents provided by the data lines in response to the select signals provided by the scan lines;

a data driver for transmitting multiplexed data currents corresponding to the data currents through a plurality of signal lines; and a demultiplex unit including a plurality of demultiplexers coupled to the signal lines, each of the demultiplexers for receiving one of the multiplexed data currents, and transmitting the data currents to at least two of the data lines, wherein at least one of the demultiplexers includes a plurality of sample/hold circuits, wherein at least two of the sample/hold circuits sample the one of the multiplexed data currents applied through an input terminal, and output the data currents corresponding to the one of the multiplexed data currents to the at least two of the data lines through an output terminal, and wherein the at least two of the data lines are coupled to pixels of the same color from among the plurality of pixels.

2. The display device of claim 1, wherein the pixels include pixels of at least two colors, and the at least two of the data lines corresponding to one of the demultiplexers are coupled to pixels of one color from among the pixels of at least two colors.

3. The display device of claim 2, wherein at least one of the sample/hold circuit includes:

a sampling switch turned on during a sampling operation;

a holding switch turned on during a holding operation; and a data storage element for storing data corresponding to one of the multiplexed data currents applied through the sampling switch during the sampling operation, and outputting one of the data currents through the holding switch during the holding operation.

4. The display device of claim 3, wherein the data storage element of the at least one of the sample/hold circuits includes a first transistor having a source and a drain respectively coupled to a first power source and a second power source through the switches, and a first capacitor coupled between a gate and the source of the first transistor, and wherein a voltage corresponding to the one of the multiplexed data currents applied through the sampling switch is stored in the first capacitor.

5. The display device of claim 4, wherein the maximum value of one of the data currents programmed to the pixel of a first color among the pixels of at least two colors is greater than the maximum value of another one of the data currents programmed to the pixel of a second color, and wherein a ratio $W_1/L_1$ of a channel width $W_1$ and a channel length $L_1$ of the first transistor of the sample/hold circuit corresponding to the pixel of the first color is greater than a ratio $W_2/L_2$ of a channel width $W_2$ and a channel length $L_2$ of the first transistor of the sample/hold circuit corresponding to the pixel of the second color.

6. The display device of claim 4, wherein the first transistor is a p channel transistor, and the maximum value of one of the data currents programmed to the pixel of a first color from among the pixels of at least two colors is greater than the maximum value of another one of the data currents programmed to the pixel of a second color, and wherein the voltage of the second power source of the sample/hold circuit corresponding to the pixel of the first color is lower than the voltage of the second power source of the sample/hold circuit corresponding to the pixel of the second color.

7. The display device of claim 4, wherein the first transistor is an n channel transistor, and the maximum value of one of the data currents programmed to the pixel of a first color from among the pixels of at least two colors is greater than the maximum value of another one of the data currents programmed to the pixel of a second color, and wherein the voltage of the second power source of the sample/hold circuit corresponding to the pixel of the first color is higher than the voltage of the second power source of the sample/hold circuit corresponding to the pixel of the second color.

8. The display device of claim 4, wherein the first transistor is a p channel transistor, and the maximum value of one of the data currents programmed to the pixel of a first color from among the pixels of at least two colors is greater than the maximum value of another one of the data currents programmed to the pixel of a second color, and wherein the voltage of the first power source of the sample/hold circuit corresponding to the pixel of the first color is higher than the voltage of the first power source of the sample/hold circuit corresponding to the pixel of the second color.

9. The display device of claim 4, wherein the first transistor is an n channel transistor, and the maximum value of one of the data currents programmed to the pixel of a first color from among the pixels of at least two colors is greater than the maximum value of another one of the data currents programmed to the pixel of a second color, and the voltage of the first power source of the sample/hold circuit corresponding to the pixel of the first color is lower than the voltage of the first power source of the sample/hold circuit corresponding to the pixel of the second color.

10. The display device of claim 4, wherein the sampling switch comprises a first switch coupled between the drain of the first transistor and the input terminal, a second switch for diode-connecting the first transistor when it is turned on, and a third switch coupled between the first power source and the first transistor, and wherein the holding switch comprises a fourth switch coupled between the second power source and the first transistor, and a fifth switch coupled to the first transistor and the output terminal.

11. The display device of claim 10, wherein the third switch is a transistor having the same conductivity as that of the first transistor, and the fourth switch is a transistor having conductivity opposite that of the first transistor.

12. The display device of claim 1, wherein at least one of the demultiplexers includes:

a first sample/hold circuit and a second sample/hold circuit, each having an input terminal coupled to one of the signal lines, and each having an output terminal coupled to one of the at least two of the data lines; and a third sample/hold circuit and a fourth sample/circuit, each having an input terminal coupled to the one of the signal lines, and each having an output terminal coupled to another one of the at least two of the data lines.

13. The display device of claim 12, wherein the second sample/hold circuit and the fourth sample/circuit hold the data currents corresponding to stored data through the data lines while the first sample/hold circuit and the third sample/circuit sample one of the multiplexed data currents applied through the one of the signal lines, and wherein the first sample/hold circuit and the third sample/circuit hold the data currents corresponding to stored data through the data lines while the second sample/hold circuit and the fourth sample/circuit sample the one of the multiplexed data currents applied through the one of the signal lines.

14. The display device of claim 1, wherein at least one of the demultiplexers includes:

a first sample/hold circuit having an input terminal coupled to one of the signal lines;

a second sample/hold circuit having an input terminal coupled to an output terminal of the first sample/hold circuit, and having an output terminal coupled to one of the at least two of the data lines;

a third sample/hold circuit having an input terminal coupled to the one of the signal lines; and a fourth sample/hold circuit having an input terminal coupled to an output terminal of the third sample/hold circuit, and having an output terminal coupled to one of the at least two of the data lines.

15. The display device of claim 14, wherein the second sample/hold circuit and the fourth sample/circuit concurrently hold the data currents through the data lines while the first sample/hold circuit and the third sample/circuit sequentially sample the one of the multiplexed data currents applied through the one of the signal lines, and wherein the second sample/hold circuit and the fourth sample/circuit sample the data currents held by the first and third sample/hold circuits while the first sample/hold circuit and the third sample/circuit hold the data currents corresponding to sampled data.

16. The display device of claim 1, wherein the pixels of at least two colors each include:

a second transistor for flowing one of the data currents transmitted through one of the data lines;

a second capacitor coupled between a source and a gate of the second transistor for storing a voltage corresponding to the one of the data currents flowing to the second transistor; and a light emitting device for emitting light in correspondence to the one of the data currents flowing to the second transistor according to the voltage stored in the second capacitor.

17. The display device of claim 16, wherein the light emitting device uses electroluminescence of organic matter.

18. The display device of claim 16, wherein the maximum value of one of the data currents programmed to the pixel of a first color from among pixels of at least two colors is greater than the maximum value of another one of the data currents programmed to the pixel of a second color, and wherein a ratio $W_3/L_3$ of a channel width $W_3$ and a channel length $L_3$ of the second transistor corresponding to the pixel of the first color is greater than a ratio $W_4/L_4$ of a channel width $W_4$ and a channel length $L_4$ of the second transistor corresponding to the pixel of the second color.

19. The display device of claim 16, wherein the source of the second transistor is coupled to a third power source, wherein the second transistor is a p channel transistor, wherein the maximum value of one of the data currents programmed to the pixel of the first color from among pixels of at least two colors is greater than the maximum value of another one of the data currents programmed to the pixel of the second color from among the pixels of at least two colors, and wherein the voltage of the third power source corresponding to the pixel of the first color is higher than the voltage of the third power source corresponding to the pixel of the second color.

20. The display device of claim 16, wherein the source of the second transistor is coupled to a third power source, wherein the second transistor is an n channel transistor, wherein the maximum value of one of the data currents programmed to the pixel of the first color from among pixels of at least two colors is greater than the maximum value of another one of the data currents programmed to the pixel of the second color from among the pixels of at least two colors, and wherein the voltage of the third power source corresponding to the pixel of the first color is lower than the voltage of the third power source corresponding to the pixel of the second color.

21. A display device comprising:

a display region having a plurality of pixels, some having the same color and some having different colors, wherein the pixels display an image responsive to data signals provided through a plurality of data lines;

a data driver for providing multiplexed data signals corresponding to the data signals through a plurality of signal lines; and a demultiplexer unit for demultiplexing the multiplexed data signals to generate the data signals, wherein at least two of the pixels of the same color display color as a function of a same one of the multiplexed data signals.

22. The display device of claim 21, wherein each of the data signals comprises a current signal.

23. The display device of claim 21, wherein the demultiplexer unit includes a plurality of demultiplexers, and wherein each of the demultiplexers demultiplexes one of the multiplexed data signals to generate at least two of the data signals and provides the at least two of the data signals to at least two of the data lines for the pixels of the same color.

24. The display device of claim 23, wherein each of the demultiplexers includes a plurality of sample/hold circuits, each of the sample/hold circuits having a transistor.

25. The display device of claim 24, wherein the data signals comprise data currents, and wherein a W/L ratio of the transistor in one of the sample/hold circuits for generating one of the data currents corresponding to one of the pixels of one color is different from a W/L ratio of the transistor in another one of the sample/hold circuits for generating another one of the data currents corresponding to one of the pixels of another color.

26. The display device of claim 24, wherein each of the sample/hold circuits is applied with a voltage from at least one power source, and wherein a voltage level of the voltage applied to one of the sample/hold circuits for providing one of the data signals to one of the pixels of one color is different from a voltage level of the voltage applied to another one of the sample/hold circuits for providing another one of the data signals to one of the pixels of another color.

27. A display device comprising:

a display region including a plurality of pixels of a first color, a plurality of pixels of a second color, each of the pixels of the second color disposed between two adjacent ones of the pixels of the first color, and a plurality of data lines respectively coupled to the pixels of the first and second colors;

a demultiplex unit including a plurality of first sample/hold circuit units respectively coupled to the data lines corresponding to the pixels of the first color, and a plurality of second sample/hold circuit units respectively coupled to the data lines corresponding to the pixels of the second color; and a data driver having an output terminal coupled to at least two sample/hold circuit units from among the first sample/hold circuit units and the second sample/hold circuit units through a signal line, wherein the first sample/hold circuit unit samples a first data current for displaying an image of the first color applied from the data driver through the signal line and outputs a current corresponding to the sampled first data current, and wherein the second sample/hold circuit unit samples a second data current for displaying an image of the second color applied from the data driver through the signal line and outputs a current corresponding to the sampled second data current.

28. The display device of claim 27, wherein the signal line comprises a first signal line coupled to at least two first sample/hold circuit units from among the first sample/hold circuit units, and a second signal line coupled to at least two second sample/hold circuit units from among the second sample/hold circuit units.

29. The display device of claim 27, wherein the signal line is coupled to at least one first sample/hold circuit unit from among the first sample/hold circuit units and at least one second sample/hold circuit unit from among the second sample/hold circuit units.

30. The display device of claim 27, wherein the first sample/hold circuit unit and the second sample/hold circuit unit each comprise a first sample/hold circuit and a second sample/hold circuit having an input terminal coupled to the signal line and an output terminal coupled to one of the data lines, and wherein the second sample/hold circuit holds while the first sample/hold circuit samples, and the first sample/hold circuit holds while the second sample/hold circuit samples.

31. The display device of claim 30, wherein at least one of the first sample/hold circuit and second sample/hold circuit includes a sampling switch coupled to the input terminal and turned on during a sampling operation, a holding switch coupled to the output terminal and turned on during a holding operation, and a data storage element coupled between the sampling switch and the holding switch, wherein the data storage element includes a transistor having a source and a drain respectively coupled to a first power source and a second power source through switches, and a capacitor coupled to a gate and the source of the transistor, and wherein the current flows to the transistor during the sampling operation to store a voltage corresponding to the current applied through the sampling switch in the capacitor, and the current of the transistor flows through the holding switch in correspondence to the voltage stored in the capacitor during the holding operation.

32. The display device of claim 31, wherein the maximum value of the first data current is greater than the maximum value of the second data current, and wherein a ratio $W_1/L_1$ of a channel width $W_1$ and a channel length $L_1$ of the transistor of the first sample/hold circuit unit is greater than a ratio $W_2/L_2$ of a channel width $W_2$ and a channel length $L_2$ of the transistor of the second sample/hold circuit unit.

33. The display device of claim 31, wherein the transistor is a p channel transistor, wherein the maximum value of the first data current is greater than the maximum value of the second data current, and wherein the voltage of the second power source of the first sample/hold circuit unit is lower than the voltage of the second power source of the second sample/hold circuit unit.

34. The display device of claim 31, wherein the transistor is an n channel transistor, wherein the maximum value of the first data current is greater than the maximum value of the second data current, and wherein the voltage of the second power source of the first sample/hold circuit unit is higher than the voltage of the second power source of the second sample/hold circuit unit.

35. The display device of claim 31, wherein the transistor is a p channel transistor, wherein the maximum value of the first data current is greater than the maximum value of the second data current, and wherein the voltage of the first power source of the first sample/hold circuit unit is higher than the voltage of the first power source of the second sample/hold circuit unit.

36. The display device of claim 31, wherein the transistor is an n channel transistor, wherein the maximum value of the first data current is greater than the maximum value of the second data current, and wherein the voltage of the first power source of the first sample/hold circuit unit is lower than the voltage of the first power source of the second sample/hold circuit unit.

37. The display device of claim 27, wherein the first sample/hold circuit unit and the second sample/hold circuit unit each comprise a first sample/hold circuit having an input terminal coupled to the signal line, and a second sample/hold circuit having an input terminal coupled to an output terminal of the first sample/hold circuit, and wherein the first sample/hold circuit samples the data applied through the signal line, and the second sample/hold circuit samples the current held by the first sample/hold circuit and holds the current corresponding to the sampled current to one of the data lines.

38. A demultiplex device comprising:

a first sample/hold circuit unit including a plurality of first sample/hold circuits for sampling a first current applied through a first signal line, and holding a current corresponding to the first current to a first data line; and a second sample/hold circuit unit including a plurality of second sample/hold circuits for sampling a second current applied through a second signal line, and holding a current corresponding to the second current to a second data line, wherein the first sample/hold circuit and the second sample/hold circuit each include a transistor having a source and a drain respectively coupled to a first power source and a second power source through switches, and a capacitor coupled between a gate and the source of the transistor, a current corresponding to the current applied through an input terminal during a sampling operation flows to the transistor to store a voltage corresponding to the current of the transistor in the capacitor, and the current of the transistor flows to an output terminal in correspondence to the voltage stored in the capacitor during a holding operation, and wherein the maximum value of the first current is greater than the maximum value of the second current, and a ratio $W_1/L_1$ of a channel width $W_1$ and a channel length $L_1$ of the transistor of the first sample/hold circuit is greater than a ratio $W_2/L_2$ of a channel width $W_2$ and a channel length $L_2$ of the transistor of the second sample/hold circuit.

39. A demultiplex device comprising:

a first sample/hold circuit unit including a plurality of first sample/hold circuits for sampling a first current applied through a first signal line, and holding a current corresponding to the first current to a first data line; and a second sample/hold circuit unit including a plurality of second sample/hold circuits for sampling a second current applied through a second signal line, and holding a current corresponding to the second current to a second data line, wherein the first sample/hold circuits and the second sample/hold circuits each include a transistor having a source and a drain respectively coupled to a first power source and a second power source through switches, and a capacitor coupled between a gate and the source of the transistor, a current corresponding to the current applied through an input terminal during a sampling operation flows to the transistor to store a voltage corresponding to the current of the transistor in the capacitor, and the current of the transistor flows to an output terminal in correspondence with the voltage stored in the capacitor during a holding operation, and wherein the maximum value of the first current is greater than the maximum value of the second current, and wherein voltage levels of the first power source of the first sample/hold circuit and the first power source of the second sample/hold circuit are different from each other and/or voltage levels of the second power source of the first sample/hold circuit and the second power source of the second sample/hold circuit are different from each other.

40. The demultiplex device of claim 39, wherein the transistor is a p channel transistor, and wherein the voltage of the second power source of the first sample/hold circuit is lower than the voltage of the second power source of the second sample/hold circuit.

41. The demultiplex device of claim 39, wherein the transistor is an n channel transistor, and wherein the voltage of the second power source of the first sample/hold circuit is higher than the voltage of the second power source of the second sample/hold circuit.

42. The demultiplex device of claim 39, wherein the transistor is a p channel transistor, and wherein the voltage of the first power source of the first sample/hold circuit is higher than the voltage of the first power source of the second sample/hold circuit.

43. The demultiplex device of claim 39, wherein the transistor is an n channel transistor, and wherein the voltage of the first power source of the first sample/hold circuit is lower than the voltage of the first power source of the second sample/hold circuit.

44. The demultiplex device of claim 39, wherein the first sample/hold circuit and second sample/hold circuit each include:

a first switch coupled between the gate of the transistor and the input terminal;

a second switch for diode-connecting the transistor when it is turned on;

a third switch coupled between the first power source and the transistor;

a fourth switch coupled between the second power source and the transistor; and a fifth switch coupled between the transistor and the output terminal.

* * * * *